US005305916A

United States Patent [19]

Suzuki et al.

[11] Patent Number: 5,305,916

[45] Date of Patent: Apr. 26, 1994

[54] DRIP FREE, VOLUME-ADJUSTABLE, AUTOMATIC LIQUID DISPENSER

[75] Inventors: Michifumi Suzuki; Atsushi Matsuura; Kenji Tsukiji, all of Tokyo; Takahiro Tomioka, Abiko, all of Japan

[73] Assignee: Kabushiki Kaisha San-Ai, Tokyo, Japan

[21] Appl. No.: 986,276

[22] Filed: Dec. 7, 1992

[30] Foreign Application Priority Data

| | | | |
|---|---|---|---|
| Dec. 9, 1991 | [JP] | Japan | 3-350238 |
| Dec. 9, 1991 | [JP] | Japan | 3-350239 |
| Jan. 30, 1992 | [JP] | Japan | 4-008964[U] |
| Jul. 29, 1992 | [JP] | Japan | 4-058612[U] |

[51] Int. Cl.[5] ..... B67D 1/00

[52] U.S. Cl. ..... 222/52; 222/181; 222/309; 222/333; 222/375; 222/490; 222/494

[58] Field of Search ..... 222/333, 309, 52, 494, 222/490, 181, 153, 375, 380, 383; 417/550, 552, 553

[56] References Cited

U.S. PATENT DOCUMENTS

| | | | |
|---|---|---|---|
| 2,464,030 | 3/1949 | Engstrom | 222/380 X |
| 2,894,665 | 7/1959 | Zerlin | 222/380 X |
| 3,434,628 | 3/1969 | Ceraldi | 222/52 |
| 3,489,099 | 1/1970 | Huffsmith, Sr. | 417/552 |
| 3,716,310 | 2/1973 | Guenther | 417/552 |
| 4,645,094 | 2/1987 | Acklin et al. | 222/52 |
| 4,917,265 | 4/1990 | Chiang | 222/52 |
| 4,967,935 | 11/1990 | Celest | 222/333 X |
| 4,991,745 | 2/1991 | Brown | 222/490 X |
| 5,033,655 | 7/1991 | Brown | 222/490 X |
| 5,058,780 | 10/1991 | Plester et al. | 222/333 X |

FOREIGN PATENT DOCUMENTS

| | | |
|---|---|---|
| 997386 | 1/1952 | France . |
| 2282545 | 3/1976 | France . |
| 1085326 | 9/1967 | United Kingdom . |
| 2118254 | 10/1983 | United Kingdom . |

*Primary Examiner*—Andres Kashnikow
*Assistant Examiner*—Anthoula Pomrening
*Attorney, Agent, or Firm*—Robert W. J. Usher

[57] ABSTRACT

In a pump, a piston rod is mounted for lost motion on a piston head so that when the piston rod 31 is advanced by a full stroke in a forward direction from a fully retracted position, only the piston rod moves for an initial stroke portion S2, then a piston head is also advanced with the piston rod for a final stroke portion which is equivalent to a difference between the full stroke S1 and initial stroke portion S2 (S3=S1−S2), and a liquid inside said cylinder is expelled from the exhaust port by a quantity corresponding the final stroke portion S3. When the piston rod is being withdrawn in the return direction, only the piston rod is moved during the initial stroke portion causing residual liquid in a passageway from the cylinder to the exhaust port to be sucked back to the cylinder.

22 Claims, 20 Drawing Sheets

D
U
30
31
31a
31d
32
32a
32b
33
33a
33b
33c
34
34a
35
36
36a
38
13
13a
S2
S3

DRIP FREE, VOLUME-ADJUSTABLE, AUTOMATIC LIQUID DISPENSER

FIELD OF THE INVENTION

The invention relates to a liquid dispenser which can repeatedly dispense the same prespecified volume of a liquid such as liquid soap, liquid detergent, shampoo, and rinse.

BACKGROUND OF THE INVENTION

In attempting to minimize or avoid any requirement for a person washing to handle a soap or detergent container with dirty or soapy hands, liquid soap dispensers of the pump type, operated either manually or automatically by hand detecting devices, are often provided.

One known automatic liquid dispenser comprises a detecting means to detect one or both hands held out under the device and a pump driving means for driving the pump. Liquid such as soap is automatically expelled over one or both hands held out thereunder by automatically driving the pump driving means when a hand is detected by the detecting means, thereby avoiding any need to handle and possibly contaminate the device.

The conventional type of pump comprises a cylinder, a piston, and a check valve, and expels a liquid from the cylinder by reciprocating the piston manually or by driving means to open or close the valve in synchronism with the reciprocal movement of the piston. The liquid in the cylinder is expelled from the exhaust port by an forward or exhaust stroke of the piston and is introduced from a vessel (tank) into the cylinder by an return or intake stroke of the piston.

However, in such prior devices the entire amount of liquid soap is not expelled, as some liquid soap remains in a passageway extending from the cylinder to the exhaust port, dripping therefrom at a later time, contaminating, for example, a bottom surface of a dispenser, which is troublesome.

SUMMARY OF THE INVENTION

An object of the present invention is to provide a liquid dispenser which does not drip.

In order to achieve the object described above, in the present invention, a liquid dispenser is constructed with a cylinder connected to a tank filled with a liquid, a piston head slidably received in the cylinder, and a piston rod connected to the piston head. Liquid in the cylinder is expelled from the exhaust port by moving the piston rod reciprocally. The piston rod can make a reciprocal movement with a first stroke S1, and the piston rod is connected for lost motion to the piston head so that it can move relatively to the piston head with an initial stroke portion S2 ($<$S1).

For the initial portion of the full stroke S1, as a result of the lost motion, the piston rod is advanced from a fully retracted position relatively towards the piston head by the distance of the initial stroke portion S2, after which, the piston head is advanced together with the piston rod by a final stroke portion S3 which is equivalent to a difference between the stroke S1 and stroke portion S2 (S3=S1−S2), and the quantity of liquid expelled from the cylinder corresponds to the displacement of the final stroke portion S3.

When, the piston rod is being withdrawn in the return direction, only the piston rod moves for the distance of the initial stroke portion S2, and in association with this movement, liquid remaining in the passageway from the cylinder to the exhaust port is sucked back into the cylinder. During the subsequent return movement of the piston rod by the final stroke portion S3, the piston head is withdrawn together with the piston rod, and the liquid in the tank is introduced into the cylinder.

It should be noted that the reciprocating movement of the piston rod described above may be carried out manually, but it is preferable to use apparatus for automatically dispensing a liquid. The apparatus may comprises a material object detecting means using, for instance, infrared rays, and a rod driving means which is operated when a detection signal from the material object detecting means is received. The piston rod is moved reciprocally once only by the rod driving means each time a detection signal is received from the material material detecting means.

Furthermore, in this case it is preferable to provide a stroke adjusting mechanism for adjusting the distance the full stroke S1 between the rod driving means and the piston rod. By adjusting the full stroke S1 with the stroke adjusting mechanism, the distance of the final stroke portion S3 can also be adjusted to adjust the quantity of liquid expelled from the exhaust port by the reciprocal movement of the piston rod.

BRIEF DESCRIPTION OF THE DRAWINGS

Embodiments of the invention will now be described by way of example only and with reference to the accompanying drawings in which.

DETAILED DESCRIPTION OF THE PREFERRED EMBODIMENTS

Figure 1:
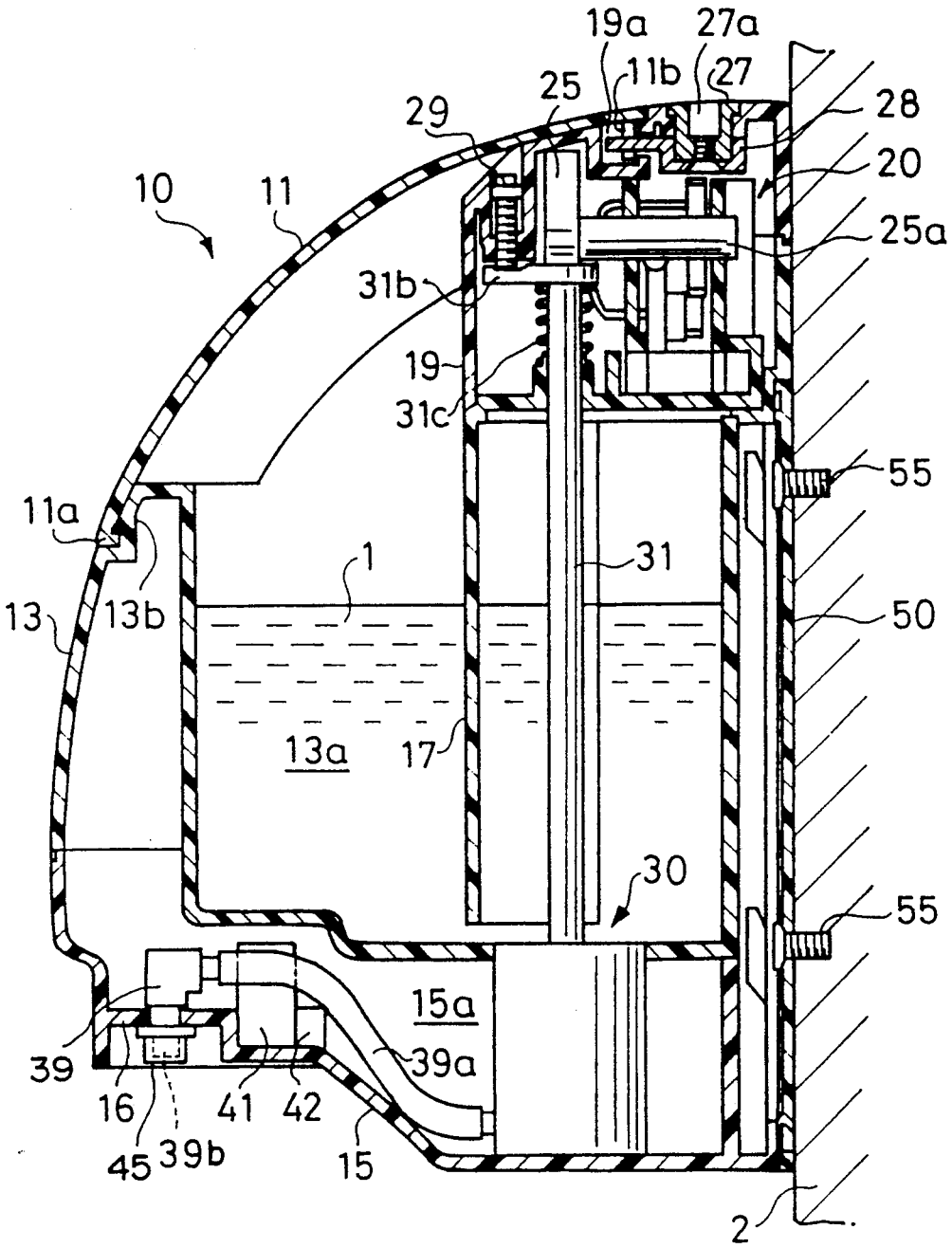
FIG. 1 is a cross section of a liquid dispenser according to the present invention.

A liquid dispenser according to a first example of the present invention comprises, as shown in FIG. 1, a plastic vessel body 10, a rod driving mechanism 20 provided in the vessel body 10, an exhaust mechanism 30, and other components.

The vessel body 10 comprises a main cover 11, an upper casing 13, a lower casing 15, a sub cover 17, and a support member 19, all of which are made of plastics. The upper casing 13 forms a tank space 13*a* for liquid soap 1. The lower casing 15 is integrally seamed or otherwise intimately joined to the upper casing 13, covering the bottom surface thereof and an exhaust mechanism 30, an exhaust nozzle 39, and sensors 41, 42 are provided in a space 15*a* enclosed between the bottom surface of the upper casing 13 and the lower casing 15.

The sub-cover 17 is fixed inside the upper casing 13 covering a front side of a piston rod 31 mounted extending vertically inside the tank space 13*a* and the support member 19 is fixed on the sub cover 17. The rod driving mechanism 20 is mounted on the sub cover 17 being supported thereby and by the support member 19.

Figure 2:
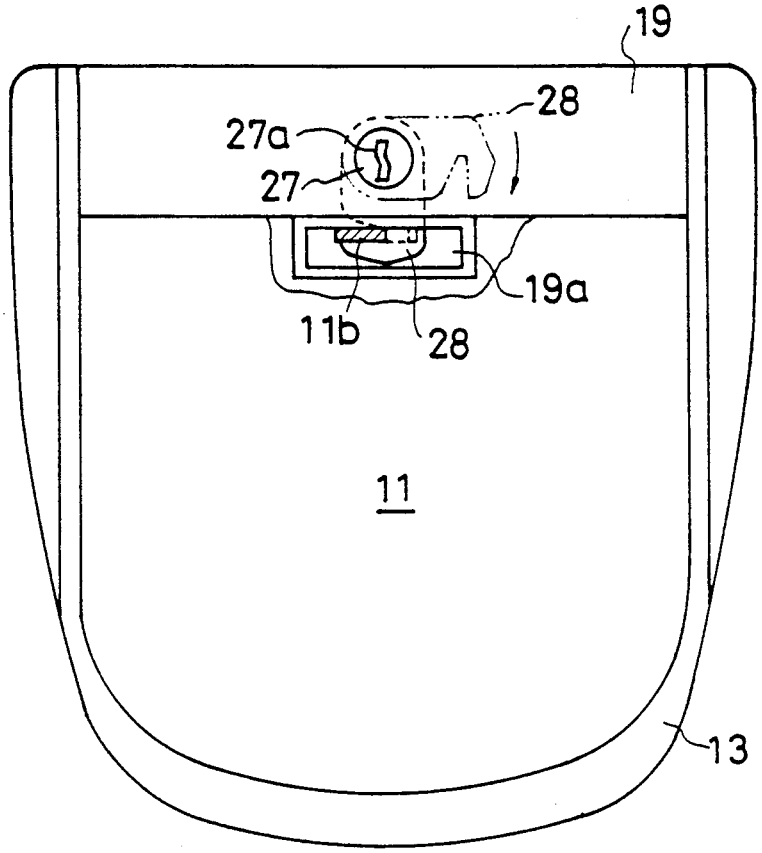
FIG. 2 is a plan view of the dispenser described above.

The main cover 11 is detachably attached to the vessel body 10 so that it covers the tank space 13*a* by hooking a protrusion 11*a* formed on a lower edge of the main cover 11 into a hooking groove 13*b* formed in the upper casing 13 and engaging a hook 28 mounted on the support member 19 with a locking arm 11*b* provided at an upper edge of the main cover 11. The hook 28 is connected to a locking member 27 at an upper edge of the support member 19 and rotatively attached to the support member 19 so that the hook 28 can be rotated from the release position indicated by a two-dot chain line in FIG. 2 to a locking position indicated by a solid (and broken) line in the figure.

When the main cover 11 has been mounted on the vessel body 10, the locking arm 11*b* protrudes into a concavity 19*a* formed in the support space 19, in lateral alignment with hook 28. The hook 28 can be rotated from a release position to the locking position by turning the locking member 27, causing the hook 28 to enter a laterally opening notch formed in the arm 11*b* to lock the arm 11*b*. Thus, the main cover can easily be attached to and detached from the vessel body 10, and when attached to the vessel body 10, can be locked in place by the hook 28, by turning the locking member 27. Thus, the main cover 11 cannot be attached to or detached from the vessel body 10 without inserting and turning a key in a keyhole 27*a* in the locking member 27.

Figure 3:
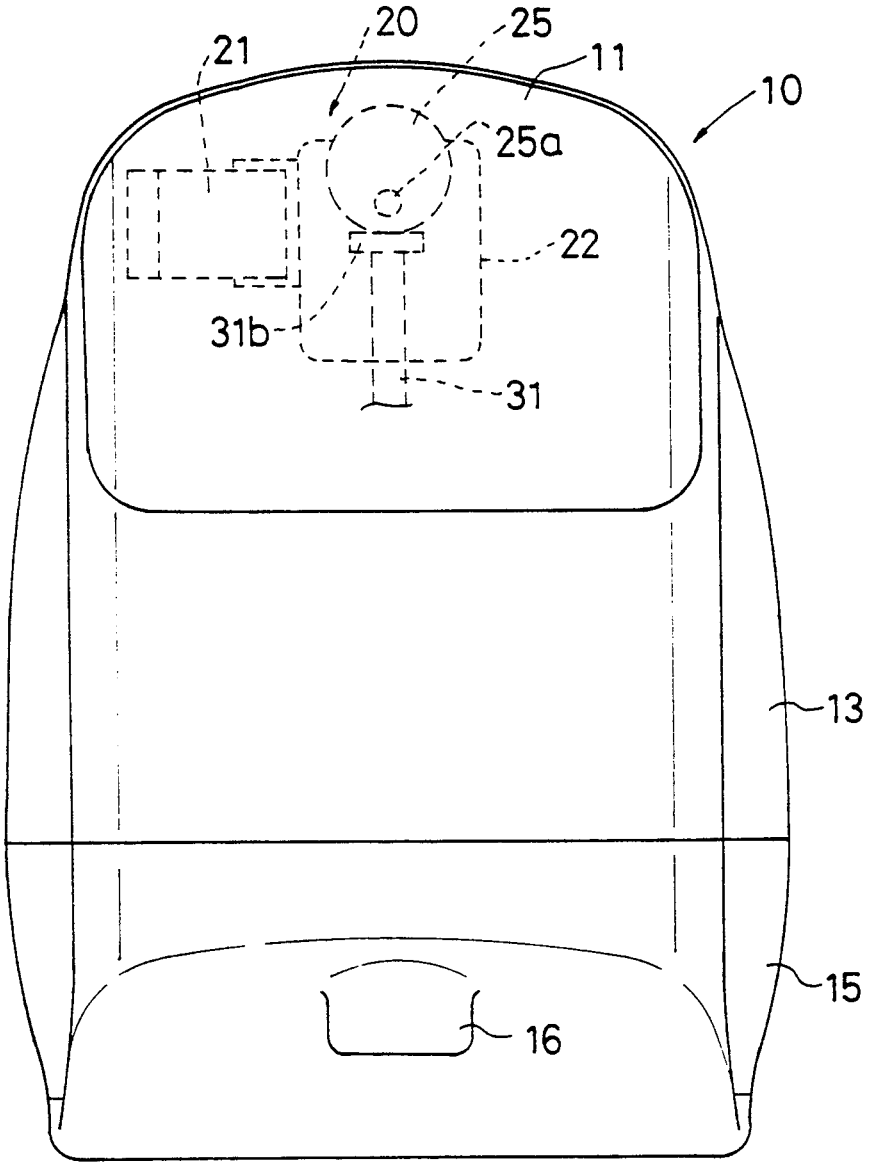
FIG. 3 is a front view of the above-described dispenser.

As shown in FIG. 3, a piston rod driving mechanism comprises an electric motor 21 in driving connection, through a reduction gear mechanism 22, with a rotary shaft 25*a* of an eccentric disk cam 25 so that operating the electric motor, rotates the eccentric disk cam 25.

Figure 4:
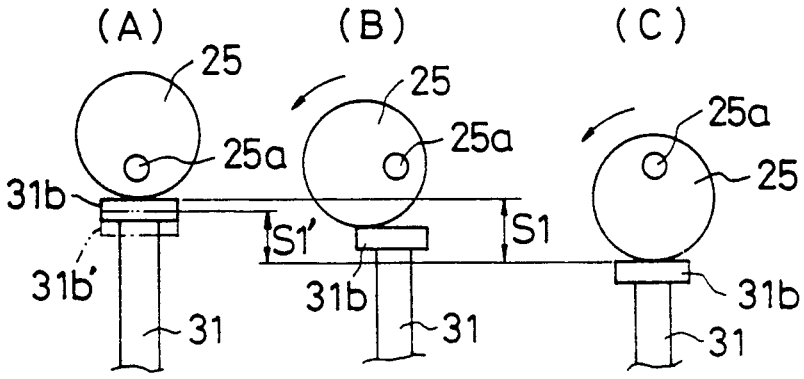
FIG. 4 is a schematic drawing demonstrating operation of an eccentric cam in the above-described dispenser.

The piston rod 31 is aligned vertically under the eccentric disk cam 25 and has a cam following contact plate 31*b* at a tip so that the piston rod 31 is reciprocated vertically, as shown in FIG. 4, by rotation of the eccentric disk cam 25. FIG. 4 (A), shows the piston rod 31 located at upper dead center and, when the cam 25 is rotated from this position in the direction indicated by the arrow, the piston rod 1 is pushed downward by the cam 25, as shown in FIG. 4(B).

When the cam 25 is rotated through 180 degrees, the piston rod 31 is moved from upper dead center to lower dead center, as shown in FIG. 4(C). Furthermore, if rotation of the cam 25 is continued, the piston rod 31 is returned upwards by a return spring 31*c* in synchronism with the rotation so that, after one complete rotation, the piston rod is returned to upper dead center, as shown in FIG. 4 (A).

Thus, a single rotation of the eccentric disk cam 25, will produce a single reciprocation of the piston rod. It should be noted that a stroke S1 of the piston rod 31 from the upper dead center to the lower dead center is called the full stroke.

As shown in FIG. 1, the contact plate 31*b* is biassed upward by the spring 31*c* into contact with a position adjusting screw 29 attached to the support member 19 at the upper dead center position rotation of which screw enables the position of the contact plate 31*b* to be adjusted.

For example, as shown in FIG. 4, when the piston rod 31 is located at the upper dead center, the contact plate 31*b* contacts the cam 25, but the position of the upper dead center can be lowered to the position 31*b*' indicated by the two-dot chain line in FIG. 4 (A), by lowering the contact plate 31*b* using the position adjusting screw 29. Thus, if the position of the upper dead center of the piston rod 31 is adjusted, the reciprocal movement stroke S1, namely the full stroke S1 and the displacement is changed to S1' (<S1).

The lower end 31*a* of the piston rod 31 is normally received in a cylinder of the exhaust mechanism 30, and when the eccentric disc cam 25 is rotationally driven by the electric motor 21 as described above and the piston rod 31 is reciprocated in the vertical direction, a prespecified quantity of liquid soap 1 determined by the reciprocal movement is expelled each time from the tank space 13*a* downward through a hose 39*a* from the exhaust nozzle 39 of the exhaust mechanism 30.

The construction and operation of the exhaust mechanism 30 are described below.

Figure 5:
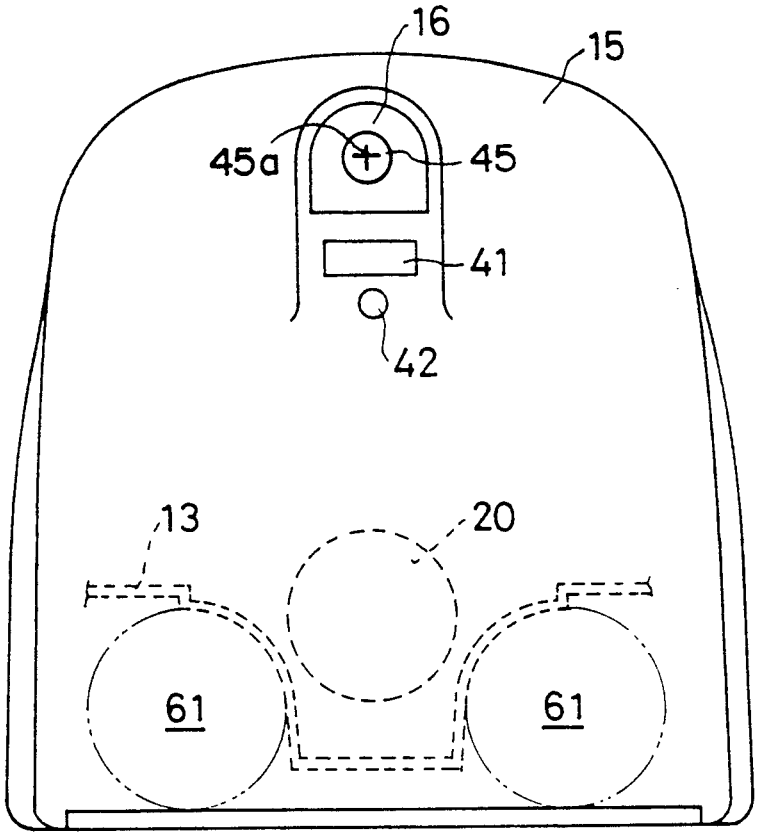
FIG. 5 is a bottom view of the above-described dispenser.
Figure 9A:
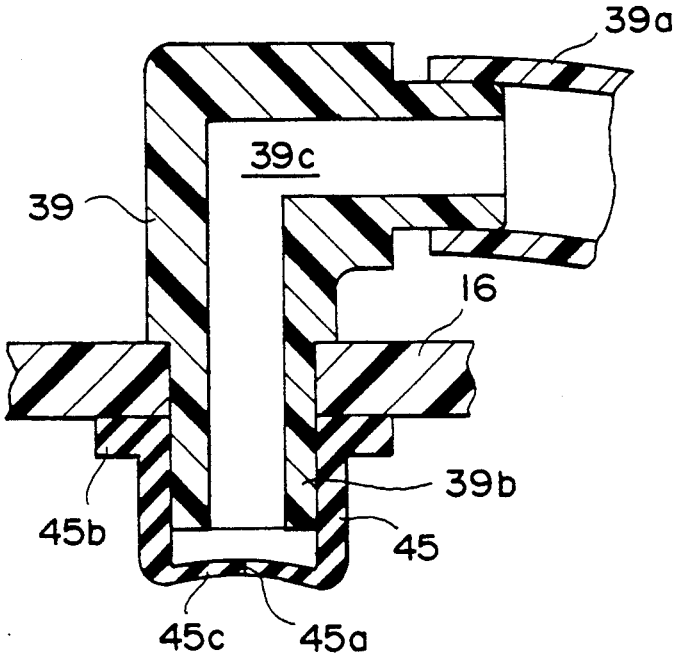
FIGS. 9A, 9B and 9C are a cross section and bottom views of the above-described dispenser each illustrating construction of the exhaust port thereof.

A cap 45 made of silicon rubber is attached to an exhaust port 39*b* of said exhaust nozzle 39 and protrudes downward from an exhaust port 16 of the lower casing 15, as shown in FIG. 5 and FIG. 9*a*. The cap 45 has a cylindrical form with a closed tip, and a flange section 45*b* is provided at a root thereof. The cap 45 is attached in covering relation to the exhaust port 39*b* of the exhaust nozzle 39 with a flange section 45*b* in tight sealing engagement with a bottom surface of the exhaust port section 16 to seal the section.

Figure 9B:
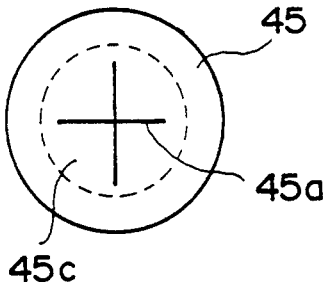
Figure 9C:
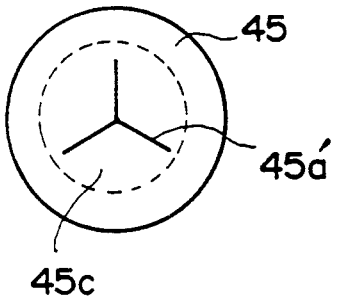

A portion (bottom surface 45*c*) of the cap 45 facing the exhaust port 39*b* is closed, and a passageway 39*c* in the exhaust nozzle 39 is closed, but a cruciform notch 45*a*, shown in FIG. 9B, is formed in this portion. It should be noted that the notch may, alternatively, be formed in a Y-shape, as shown in FIG. 9C (indicated by the sign 45*a*').

An infrared sensor 41 which detects one or both hands held out under the exhaust nozzle 39 and a photo sensor 42 which detects the surrounding brightness are located adjacent the rear of the exhaust nozzle 39. Signals detected by these sensors 41 and 42 are used for controlling the electric motor 21.

Figure 6:
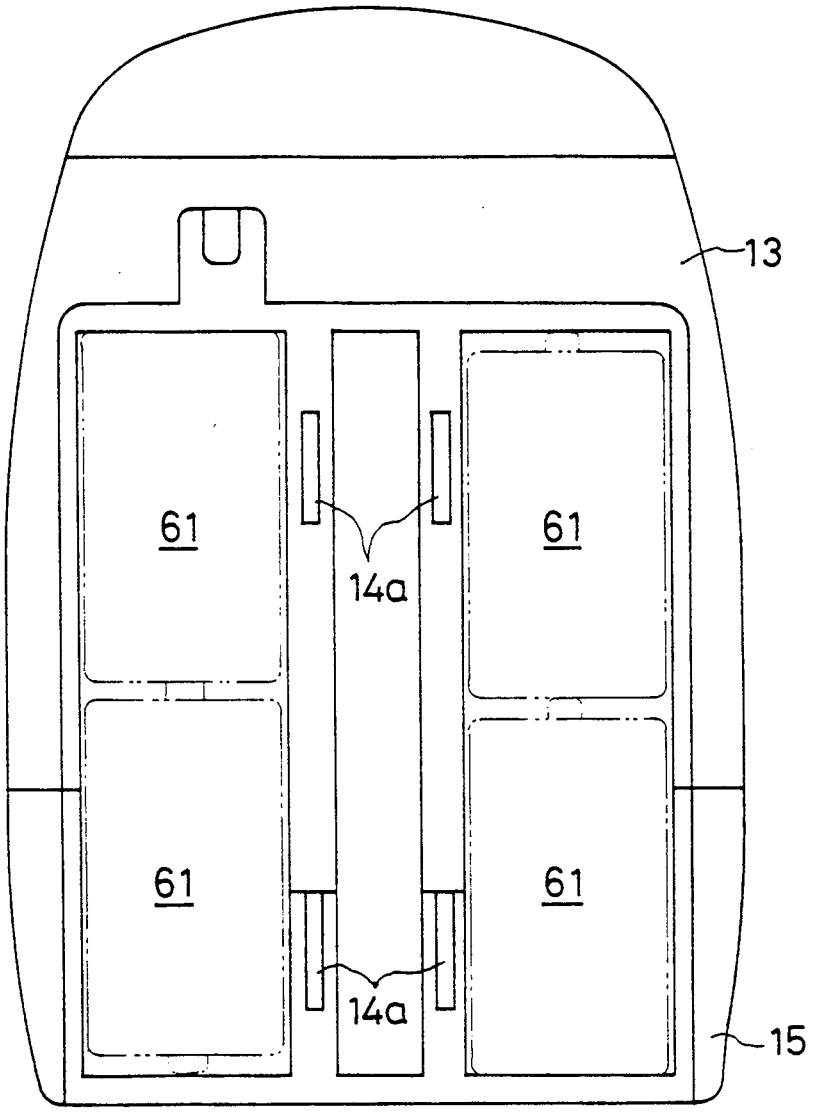
FIG. 6 is a rear view of the above-described dispenser.

The device incorporates a dry battery 61 to power the electric motor 21. As shown in FIG. 5 and FIG. 6, the dry battery 61 can be inserted into and housed in a battery compartment provided in an area at the back of a rear section wall of the upper casing 13. It should be noted that the compartment is open to the rear side and is covered by a mount plate 50 when the device is mounted by the mount plate 50 to a support such as a wall.

Figure 7A:
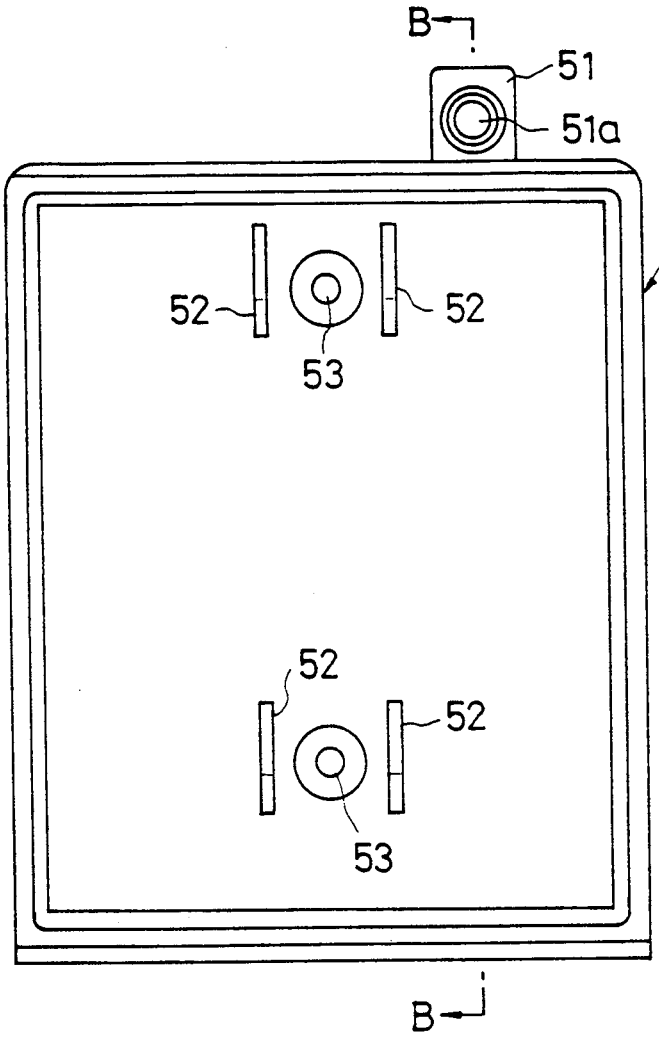
FIGS. 7A and 7B are a front view and a cross section of a mount plate, respectively.
Figure 7B:
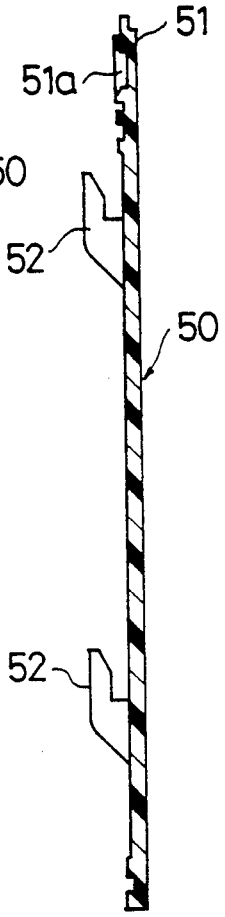

The mount plate 50 is a rectangular flat plate-form member as shown in FIGS. 7A and 7B, with a locking ear 51 extending from an upper edge and formed with a locking aperture 51*a*. Upper and lower pairs of mounting hooks 52 are formed on an inner surface of the mount plate 50 (which surface faces the dry battery 61 when said device is mounted), as shown in the figures. Threaded apertures 53 are formed at locations between the mounting hooks of the upper and lower mounting pairs, respectively, and the mount plate 50 is fixed to a wall 2 by set screws 55 passed through respective threaded apertures 53, as shown in FIG. 1.

As shown in FIG. 6, upper and lower pairs of mounting slots 14*a* located for receipt of the upper and lower pairs of the mounting hooks 52, respectively, are formed on a rear surface of the vessel body 10 enabling the entire device to be mounted by the mount plate 50 on the wall 2 by inserting the mounting hooks 52 of the mount plate 50, when fixed to the wall 2, into the mounting slots 14*a*.

Figures 8A, 8B:
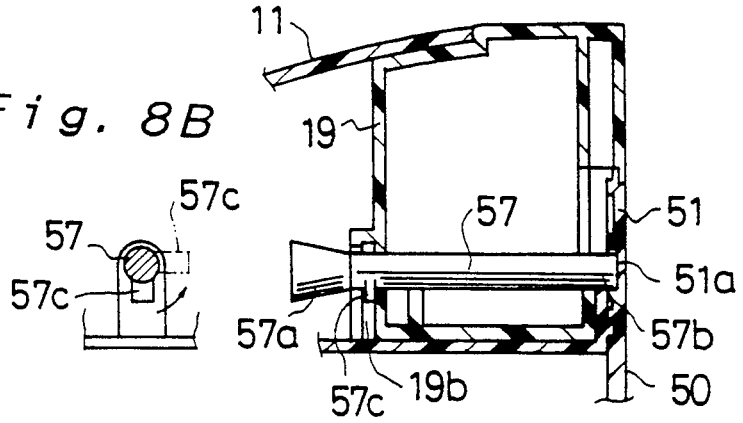
FIGS. 8A and 8B are cross sections each illustrating a portion of the above-described dispenser.

When mounted as described, however, the entire device is only held by the mounting hooks 52 on the mount plate 50, and may easily be removed from the mounting hooks 52 by lifting by hand. To prevent this, when mounted, the entire device is locked by a locking bar 57 which is inserted through the support member 19 into a locking socket 51*a* on the ear section 51 of the mount plate 50, as shown in FIG. 8A.

The locking bar 57 is inserted from the inside, (from the side of tank space 13*a*) of the vessel body 10, through a through- hole formed through the support member 19 in alignment with the locking socket 51*a* described above. As a result, when the locking bar 57 is inserted into the through-hole holding the knob section 57*a*, a tip 57*b* thereof seats in the locking socket 51*a*, thereby locking the entire device mounted on the mount plate 50.

A lateral, latching protrusion 57*c* is provided on the locking bar 57, so that when the fully inserted locking bar is rotated, the latching protrusion 57*c* enters the space 196 between two wall panels in the front side of the support member 19, maintaining the device fixed in position.

As locking and mounting can be effected by access to the locking lever 57 only from inside the vessel body 10, the entire device cannot be mounted or removed from the mount plate 50 unless the main cover has been removed which requires the insertion of a key into the locking hole 27*a* on the main cover 11 and turning the locking member 27. As a result of this construction, the device cannot easily be removed, which is useful for the prevention of inadvertent or unauthorized removal, such as theft.

The construction and operation of the exhaust mechanism 30 will now be described.

As shown in FIGS. 10A through 10E, the exhaust mechanism 30 has a cylinder 32 fixed to the upper casing 13 and a piston head 33 slidably mounted in a cylinder bore 32*a* which opens upwards (to the tank space 13*a*). A sealing ring 33*c* is provided on the piston head. A vertically extending, rod receiving passageway 33*a* is formed through the center of the piston head 33 and a lower end section 31*a* of a piston rod 31 is slidably received in the rod receiving passageway 33*a* for lost motion relative to the piston head. A downward protruding push rod 31*d* is attached to a lower face of the piston rod 31. A ring of communicating ducts 33*b* each extending vertically through the piston head 33 surround the rod receiving passageway 33*a*. Furthermore, a bottom surface of the piston head 33 is formed with a downwardly protruding ring-form protrusion 33*c* surrounding the insertion hole 33*a*.

A disc-form valve member 35 is immovably fixed to the piston rod 31 and located between radially inwardly extending, tip locking sections 34*a* of a plurality of locking arms 34 each extending upwards from a peripheral section of the piston head 33. As a result, the piston rod 31 can move relative to the piston head 33 from a position where the valve member 35 contacts the tip locking sections 34*a* of the locking arms 34, (for instance, a position shown in FIG. 10A) to a position where the valve member 35 contacts the top surface of the piston head 33, (a position shown in FIG. 10B). The distance of the relative movement or lost motion is called the initial stroke portion S2.

As shown, an inner passageway 32*b* is formed in the cylinder 32, with one end opening to a bottom surface of the cylinder bore 32*a*, while the other end communicates with the exhaust nozzle 39 via a hose 39*a*. However, a check valve comprising a ball 36 biased in a closed position by a spring 36*a* is mounted in the passageway near the opening on the bottom surface of the cylinder bore 32*a*.

The operation of the exhaust mechanism is described below.

Figures 10A, 10B, 10C:
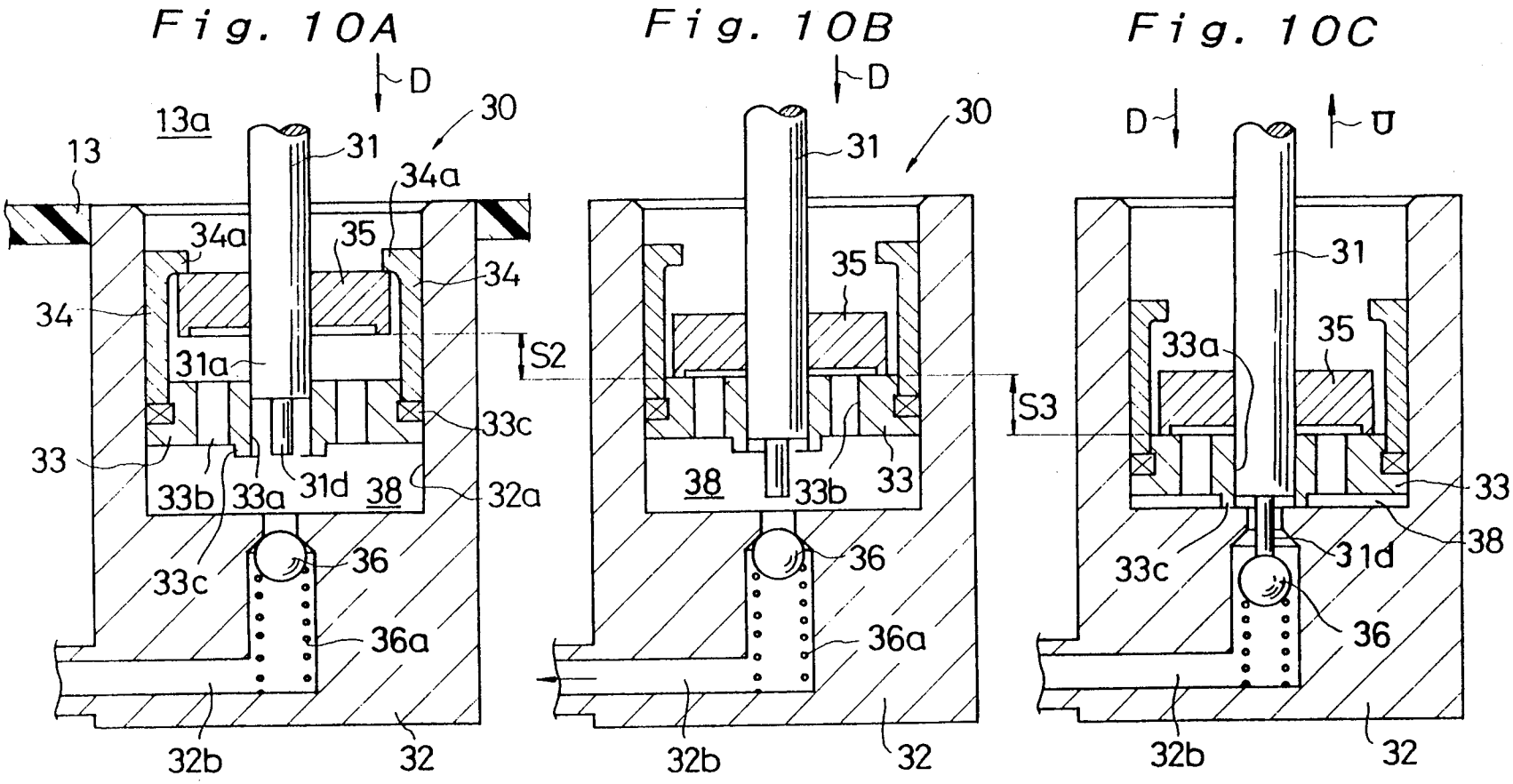
FIGS. 10A through 10E are cross sections of the above-described dispenser, each illustrating the exhaust mechanism of the dispenser.

A limit switch (not shown) for detecting whether the eccentric disc cam 25 is at the upper dead center is mounted on the rod driving mechanism 20, and normally, the eccentric disc cam 25 stops at upper dead center, and the piston rod is maintained at upper dead center as shown in FIG. 10A. When the electric motor 21 is operated to push the piston rod downward (in the direction indicated by the arrow in the figure), during the initial portion of the exhaust stroke only the piston rod 31 and the valve member 35 fixed thereto are moved downward.

The lower end section 31*a* of the piston rod 31 is moved down the rod receiving passageway 33*a*, and the liquid soap 1 in this space is pushed out or expelled to a pressure chamber or space 38 defined between the cylinder bore 32*a* and the piston head 33, but as such pressure chamber communicates via the communicating ducts 33*b* to the tank space 13*a*, the pressure in the chamber does not increase substantially and liquid soap 1 is not pushed into the inner passageway 32*b*.

As shown in FIG. 10B, when all the lost motion has been taken up and the piston rod 31 has been moved downward so that the valve member 35 contacts the top surface of the piston head 33, for a distance corresponding to the stroke portion S2, the piston rod 31 subsequently carries the piston head downward. As the communicating ducts 33*b* of the piston head 33 are closed by the valve member 35 contacting the top surface thereof, the pressure of the liquid soap inside the pressure chamber 38 is increased by the piston head 33 and depresses the ball 36 of the check valve so that the liquid soap inside the pressure chamber 38 is expelled into the inner passageway 32*b* during the downward movement of the piston head 33 and through the hose 39 toward the exhaust nozzle 39.

Figure 11C:
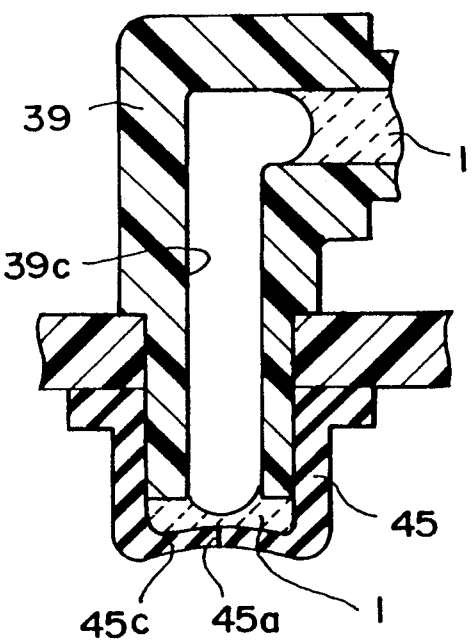
FIGS. 11A, 11B and 11C are cross sections of the above-described dispenser illustrating the exhaust mechanism thereof in successive operating positions.
Figure 11B:
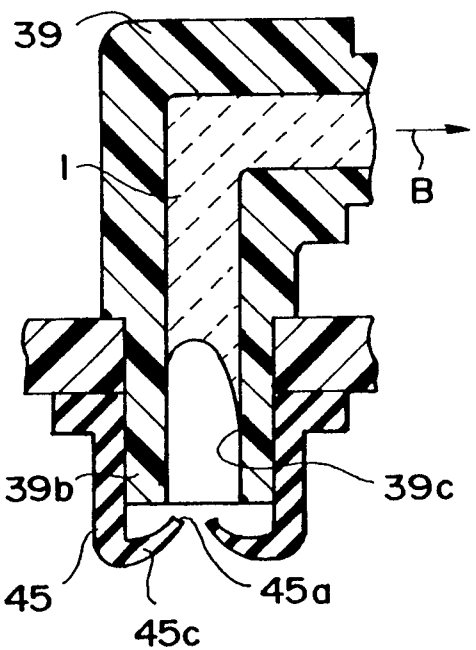
Figure 11A:
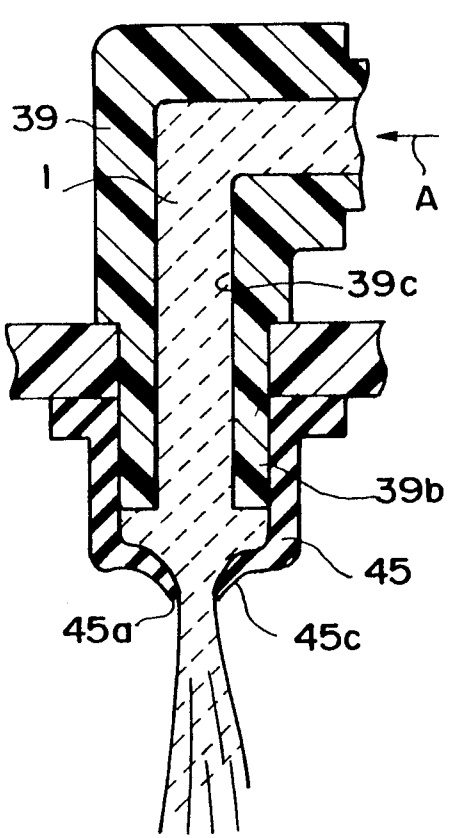

The liquid soap expelled to the exhaust nozzle 39 as described above moves in the direction indicated by the arrow A in FIG. 11A and passes through the passageway 39*c* in the nozzle 39 flowing up to the bottom surfaces 45*c* of the cap 45. As the cruciform notch 45*a* is formed in the bottom surface 45*c*, the bottom surface 45*c* is deformed outwardly by the liquid pressure at the notch 45*a* due to the working pressure of the liquid soap 1, expanding the notch, and the liquid soap is expelled to the exterior.

The expulsion of soap from the exhaust nozzle 39 continues until the piston rod 31 moves to the lower dead center (a position shown in FIG.10C). As a result, the liquid soap is expelled from the exhaust nozzle 39 by a quantity corresponding to a stroke portion from the position shown in FIG.10B to the position in FIG.10C (this is called the final stroke portion). As a complete stroke of the piston rod 31 from the upper dead center to the lower dead center is the full stroke S1, the following equation applies:

$$S1 = S2 + S3$$

When the piston rod approaches the lower dead center, the push rod 31*d* protrudes into the inner passageway 32*b* and forcefully depresses the ball 36. In addition, when the piston rod 31 is at lower dead center, as shown in the figure, the annular protrusion 33*c* formed on the bottom surface of the piston head 33 contacts the bottom surface of the cylinder bore 32*a* surrounding and sealing the opening of the inner passageway 32*b*.

After the piston rod has reached the lower dead center (outward movement), then the piston rod 31 is moved upward (inward movement) in the direction indicated by the arrow mark U according to the rotation of the cam 25 at the return or intake stroke. As the piston rod moves relatively to the piston head 33, at first only the piston rod 31 and the valve member 35 are moved upward so that a space defined by the rod receiving passageway 33*a* remains sealed from the pressure chamber 38 by the annular protrusion 33*c* but communicates with the inner passageway 32*b* as the check valve remains pushed open by the push rod 31*d*, causing liquid soap remaining inside the inner passageway 32*b* to be sucked back into the rod receiving passageway 33*a* solely as a result of the upward movement of said piston rod 31. As a result of the negative pressure generated, the bottom surface 45*c* of the cap 45 is deformed and expanded inwardly opening the notch 45*a*, as shown in FIG.11B, so that the ambient air is sucked into the passageway 39*c* permitting liquid soap still remaining in the passageway 39*c* to be sucked back along the hose 39*a* as indicated by the arrow B.

Figure 10E:
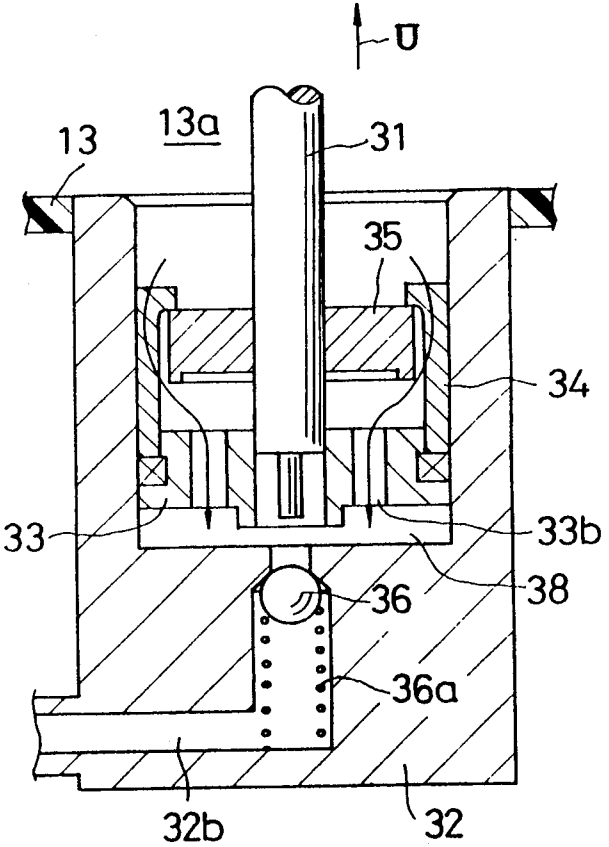
Figure 10D:
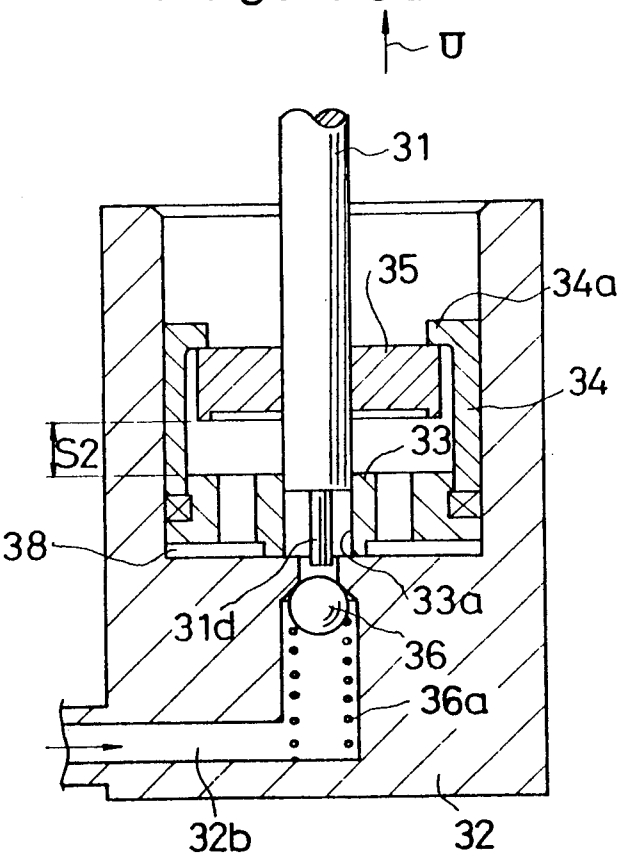

Upward movement of only the piston rod and the valve member 35 continues until the valve member 35 contacts the tip locking sections 34*a* of the locking arms 34, as shown in FIG.10D, namely until the piston rod has been moved by the initial stroke portion S2. It should be noted that, when the piston rod 31 is moved upward to the position shown in FIG.10D, the push rod 31*d* at the lower edge thereof has been removed from the ball 36, closing the check valve and closing the inner passageway 32*b* from the pressure chamber 38.

Subsequent upward movement of the piston rod raises causing the valve member 35 to raise the piston head 33 via the locking arms 34, so that the valve member moves upward with the piston rod 31 by an amount equal to the final stroke portion S3.

Thus, when the piston head 33 is moved upward together with the piston rod 31, as shown in FIG.10E, the liquid soap inside the tank space 13*a* flows into the pressure chamber 38 via the communicating ducts 33*b* and between a plurality of locking arms 34. When the piston rod 33 has moved upward to the upper dead center, the state shown in FIG.10A is restored, and then the pressure chamber 38 is filled with the liquid soap.

The condition of the exhaust nozzle 39 with the exhaust mechanism in the position shown in FIG.10A is shown in FIG.11C. Then, as described above, the liquid soap 1 in the passageway 39C has been sucked back into the hose 39*c* in the initial stage of the upward movement (inward movement) of the piston rod 31. Even though the liquid soap is sucked back as described above, however, a very small amount of the liquid soap 1 still remains on an inner wall surface of the passageway 39*c*, and flows downward due to gravity, gathering inside the cap 45 as shown in FIG.11C. Here, the bottom surface 45*c* of the cap 45 remains closed as shown in the figure, absent a pressure difference thereacross, so that the small amount of liquid soap will remain in the cap, and thus dripping will not occur.

Furthermore, the liquid soap 1 inside the cap 45 is sealed from the external air by the closed bottom surface 45*a* of the cap 45, preventing solidification. However, the cap 45 is detachably attached to the exhaust nozzle 39, and even if the soap 1 is solidified inside the cap 45, it can be washed away after only removing the cap.

As described above, a prespecified volume of liquid soap is expelled and dispensed from the exhaust nozzle 39 according to the reciprocal movement of the piston rod 31, which volume can be adjusted by adjusting the reciprocal stroke (full stroke) S1 of the piston rod 31 with the position adjusting screw 29.

The position adjusting screw 29 is used to adjust a position of the upper dead center of the piston rod 31, and therefore the full stroke S1, as described in relation to FIG.4. Even if the full stroke S1 is adjusted, the initial stroke portion S2, which is the stroke portion of the relative movement of the piston rod 31 toward the piston head 33, that is, the lost motion, does not change, and only the final stroke portion changes. The final stroke portion S3 is a stroke portion for a movement of the piston head 33, and a volume of liquid soap to be expelled is specified by this stroke portion.

Figure 12:
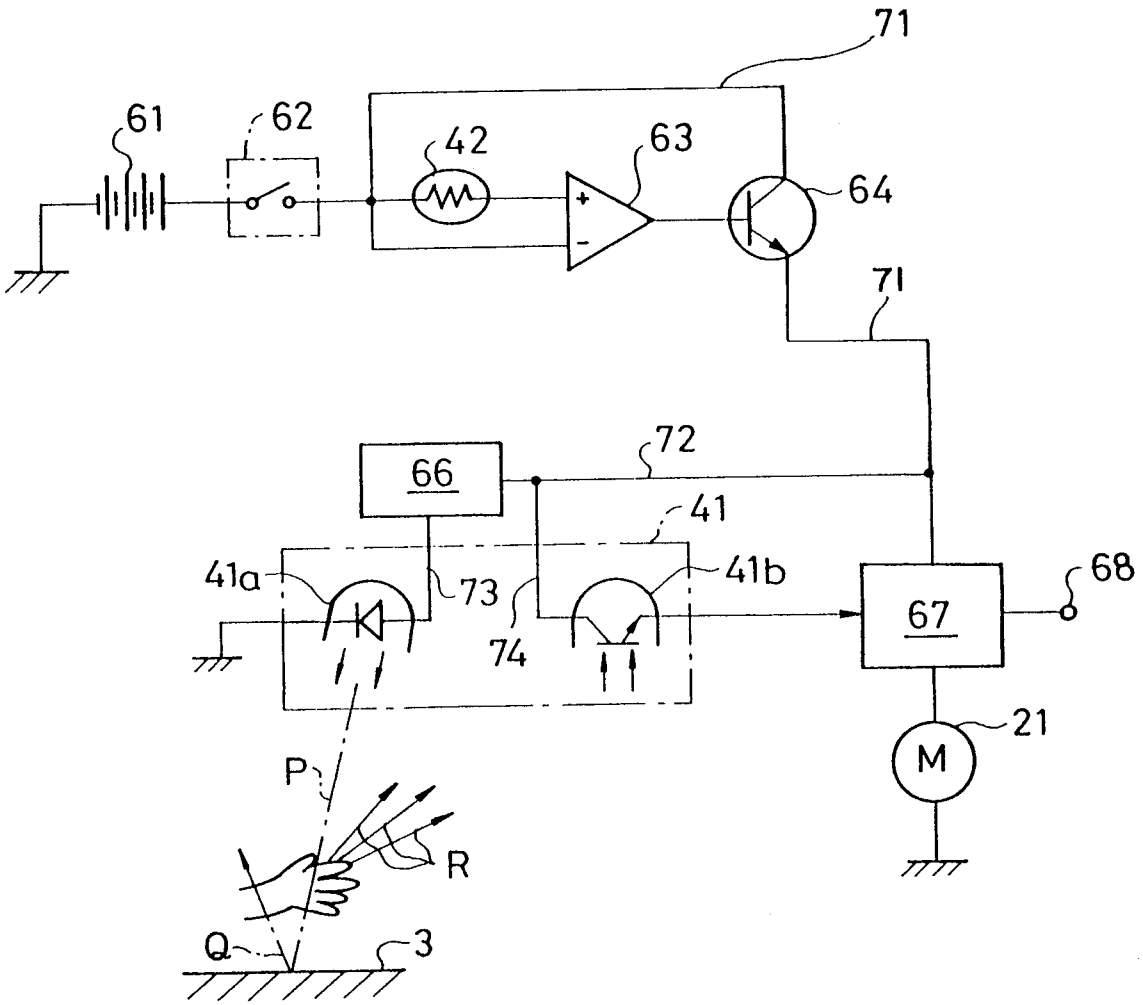
FIGS. 12 is a drawing showing an electric circuit for controlling operations of a dispenser according to the present invention.

In the dispenser of this embodiment, the electric motor is automatically driven so that the liquid soap is automatically expelled. The operation control unit for the automatic control is described below with reference to FIG.12.

The control unit performs its functions basically by controlling power supply from a battery 61 to a motor 21 with a motor driver 67. A main switch 62 is connected to the battery 61, and ON/OFF controls over the device are provided by manually operating the main switch 62.

The device may be constructed so that it will always work when the main switch 62 is ON, but the device in this embodiment has been constructed so that output from a photo sensor 42 is input to a comparator 63 and an ON signal is output from the comparator 63 to a base of a transistor 64 only when the ambient illumination is bright, the power supply via the transistor 64 being enabled to set the device in a workable state.

The dispenser having the construction as described above is usually kept indoors, but it is used only in such cases as those where, for instance, a lamp in a room is turned on to providing sufficent ambient light around the device, so that, when the lamp is off and it is dark around the device, power supply from switch 62 is interrupted and consumption of power generated by the battery 61 is suspended.

When the ambient illumination is bright and the switch 62 is turned on, the battery 61 is connected to the motor driver 67 via a line 71, and at the same time also it is connected via a line 72 to a light emission controlling means 66. The light emission control means 66 is connected via a line 73 to an infrared light emitting diode 41*a*, and a prespecified infrared ray is emitted from the light emitting diode 41*a* as indicated by the arrow in the figure.

An infrared light receiving transistor 41*b*, and an infrared sensor comprising the infrared light emitting diode 41*a* and the infrared light receiving transistor 41*b* are arranged in a line 74 branching from the line 72.

The infrared sensor 41 is mounted on the vessel body 10 with its bottom surface facing downward. Because of this construction, when one or both hands are held out under the bottom surface of the device as shown in the figure, light R emitted from the infrared light emitting diode 41*a* and reflected by a hand hits the infrared light receiving transistor 41*b*, turning the transistor 41*b* on which ON signal is sent to the motor driver 67 and the electric motor 21 is operated. In brief, only when a hand is held out under the device is the motor 21 driven and a prespecified volume of liquid soap is expelled from the exhaust nozzle 39 over a hand held thereunder.

The dispensing device is attached, for instance, onto a wall surface as shown in FIG.1, but if the device is near a floor surface 3 (or a surface of a table or other furniture) under it, the infrared light emitted from the light emitting diode 41*a* is reflected from the floor surface, and the reflected light may enter the light receiving transistor 41*b* and turn it on. To prevent this, in the device in this embodiment, the light beam from the light emitting diode 41*a* is inclined away from the light receiving transistor 41*b*, so that the infrared light is reflected from the surface away from the location of the light receiving transistor 41*b*, as indicated by the chain lines P and Q in the figure.

In contrast, when one or both hands are held out under the nozzle, the infrared light from the light emitting diode 41*a* is reflected at random, and at least a portion of hits and turns on the light receiving transistor 41*b*. For this reason, the infrared sensor 41 is not affected by reflection from the floor surface 3, whilst one or both hands are held thereunder, are accurately detected without fail.

However, if light is emitted continuously from the light emitting diode 41*a*, the battery 61 will rapidly be exhausted, and therefore the light emission control means 66 causes the infrared light to be emitted intermittently, at specified time intervals, from the light emitting diode 41*a*. For this reason, it is preferable to make the time interval for light emission as long as possible and the light emission time as short as possible. However, if a person has to hold out his hands under the exhaust port for too long before liquid is expelled, it causes uncertainty, and it is therefore desirable to make the time interval for light emission as long as possible without causing uncertainty. If the light emission time is too short, an adequate quantity of reflected infrared light is not incident on the light receiving transistor, which may sometimes prevent the infrared sensor from working normally, therefore, the light emission time should be set in a range where the problems described above will not occur. In practice, if the device is controlled so that the light emission is carried out for 0.1 sec, once every 1 second, the power required for emission of light reduced to about one tenth, and the battery 61 can be used for a longer period.

On the other hand, a signal from a limit switch which detects that the eccentric cam 25 (or the piston rod 31) has been positioned at upper dead center is input to the motor driver 67. The motor driver 67 drives the motor 21 upon an ON signal from the infrared light receiving transistor 41*b*, and when the eccentric cam 25 is turned once by the motor 21 and returns to the upper dead center, a signal from the limit switch is input, and operation of the motor 21 then stops.

Specifically, when the motor driver 67 receives an ON signal from the infrared light receiving transistor 41*b*, it controls the motor 21 so that the piston rod 31 is reciprocated once and liquid soap for one operation is expelled.

While reception of an ON signal from the infrared light receiving transistor 41*b* continues, however, the motor driver causes only a single motor cycle and only one expulsion. Because of this mechanism, even if a hand remains held out out under the device, only expulsion for one operation is carried out. On withdrawal of the hand the ON signal is stopped, the motor driver is set in a stand-by status for the next operation so that when a hand is held out again, a single operation expelling liquid soap is carried out.

As described above, in the operation control unit, power conservation is carried out by ON/OFF operation of the relay by the photo sensor 42 according to the surrounding brightness as well as by intermittent light emission from the light emitting diode 41*a*, so that a life of the battery can be made longer substantially as compared to that of conventional devices. In this embodiment, for instance, if power conservation is not carried out as described above, replacement of a battery is required every few days. However, by carrying out power conservation as in this device, battery life is several months.

Figure 13:
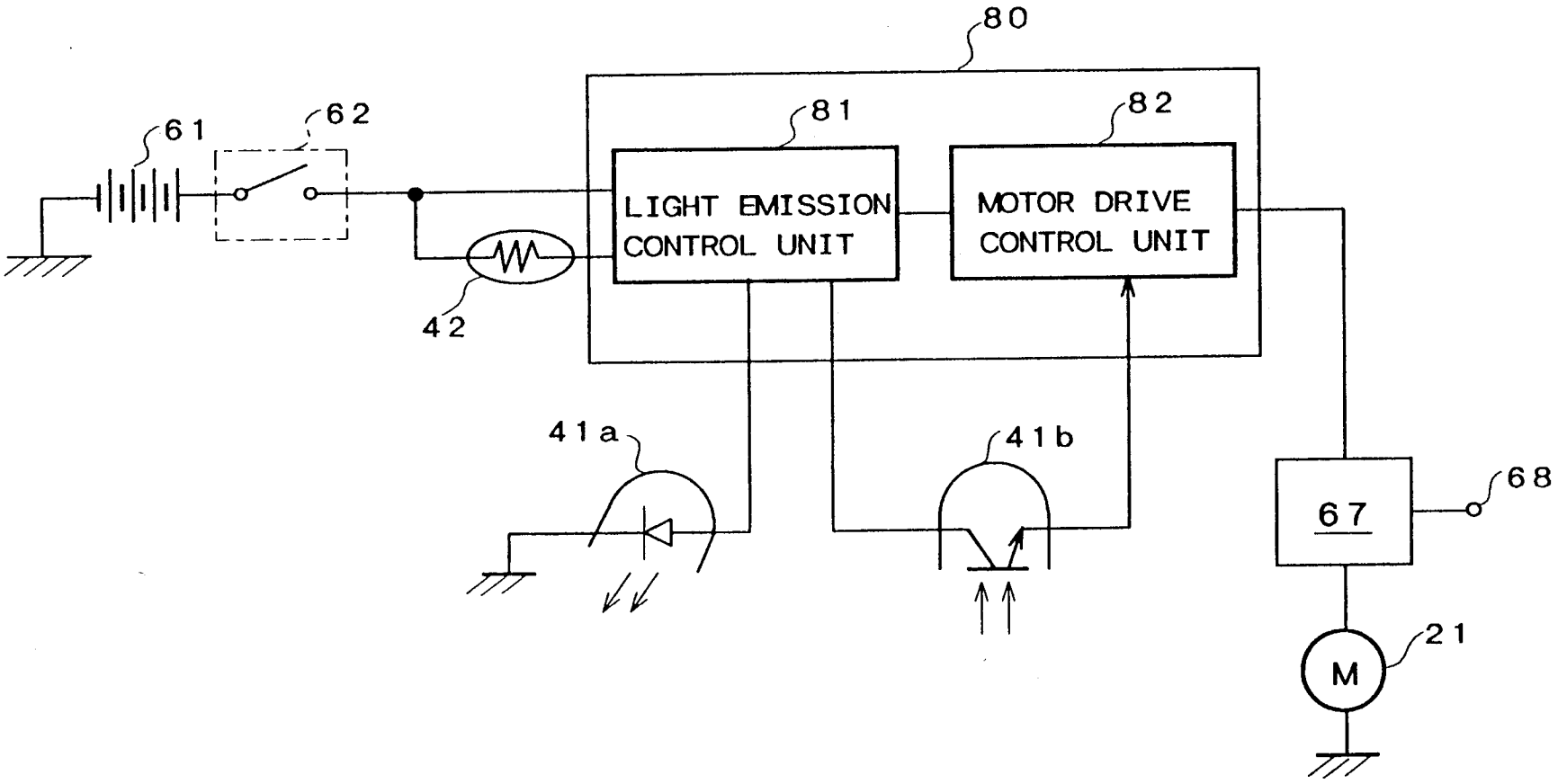
FIG. 13 is an electric circuit diagram showing a different example of a circuit for controlling operations of the dispenser according to the present invention.

As shown in FIG.13, a control circuit as described above can be made by using a microcomputer 80. The microcomputer 80 comprises a light emission control unit 81 to control light emission from the light emitting diode 41*a* and a motor driving control unit 82 to control the operation of the motor 21 via the motor driver 67.

The control circuit has the main switch 62 connected to the battery 61 and the photo sensor 42 connected to an output side of the main switch 62. An output signal from the main switch 62 and an output signal from the photo sensor 42 are input to the light emission control unit 81, and only when the main switch 62 is on and an ON signal from the photo sensor 42 is input, is a light emission signal input from the light emission control unit 81 to the light emitting diode 41*a*, and infrared light is emitted from the light emitting diode 41*a*. It should be noted that the light emission is also carried out at a prespecified time interval for power conservation.

An output signal from the light receiving transistor 41*b* is input to a motor driving control unit 82, and when an ON signal is input from the transistor 41*b*, the motor driving control unit 82 sends power from the battery 61 to the motor driver 67 to operate the electric motor.

In the operation control unit described above, operation of this device is started by the photo sensor 42 only when it is bright around the device. For that purpose, a cover may be attached closable to cover the photo sensor 42 to prevent the control unit from working when the dispenser unit is not in use.

Various types of construction are available for an exhaust mechanism in a dispenser mechanism according to the present invention.

FIGS.14A through 14E show the operation of an exhaust mechanism 130 according to the second embodiment of the present invention, described below.

The exhaust mechanism 130 has a cylinder casing 132*a* fixed to an upper casing 13, a cylinder member 132*b* inserted into and fixed on the cylinder casing 132*a* from the upside, and a piston head 133 slidably mounted inside a cylinder bore 32*c* formed in the cylinder head 132*b* with the opening facing upward (to the tank space 13*a*). A vertical, rod receiving passageway 133*a* is formed through a center of the piston head 133, and a rod member 131 connected to a lower end of the piston rod 31 is slidably received in the rod receiving passageway 133*a*. On the lower end of the rod member 131 a pressing section 131*b* is formed to protrude downward from the rod receiving passageway 133*a* and has a larger diameter than that of the rod receiving passageway 133*a*.

On the top surface of the piston head 133 an annular V-shaped groove 133*b* is formed, and a plurality of communicating ducts 133*c* are formed in and penetrate the V-shaped groove. On the rod member 131 is arranged a ringformed valve protrusion 131*c* facing the V-shaped groove from the upperside. Because of this construction, the rod member 131 can make a relative movement towards the piston head 133 from the position where an upper edge of the pressing section 131*b* contacts the bottom surface of the piston head 133 (the position shown in FIG.14A) to the position where the valve protrusion 131*c* contacts the V-shaped groove 133*b* (the position shown in FIG.14B), which distance is the initial stroke portion S2.

A check valve 136 energized by a spring 136*a* is attached to the bottom surface of the cylinder member 132*b*, and an inner space of the cylinder casing 132*a* is divided by the cylinder member 132*b* and the check valve 136 to an upper pressure chamber or space 138*a* and a lower space 138*b*. It should be noted that the lower space 138*b* communicates from an inner passageway 138*c* via a hose 39*a* to the exhaust nozzle 39.

Operation of the piston rod during reciprocal movement in the vertical direction will now be described.

Figures 14A, 14B, 14C:
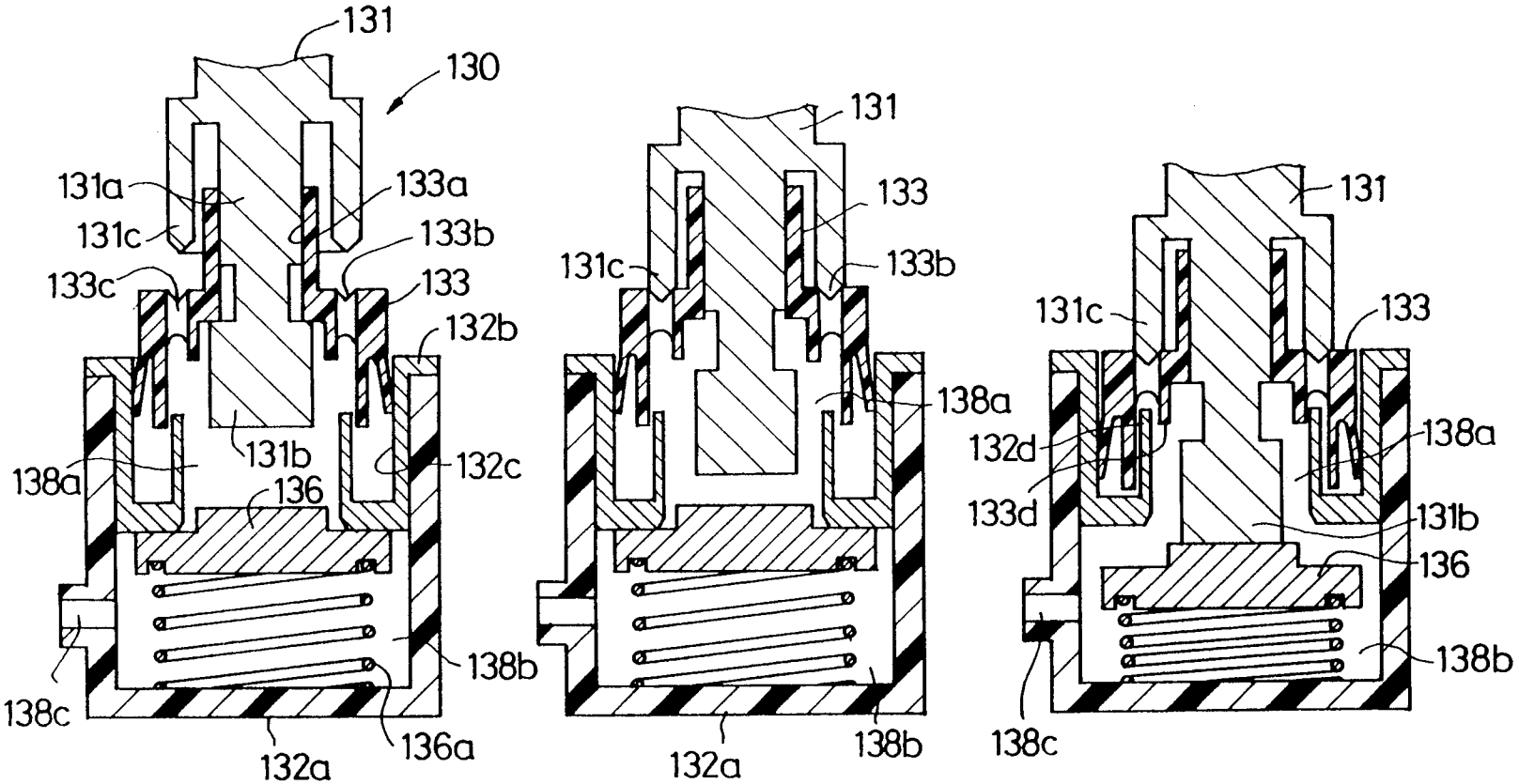
FIGS. 14A through 14E are cross sections of an exhaust mechanism of a dispenser according to a second example of the invention, in successive operating positions.
Figure 14E:
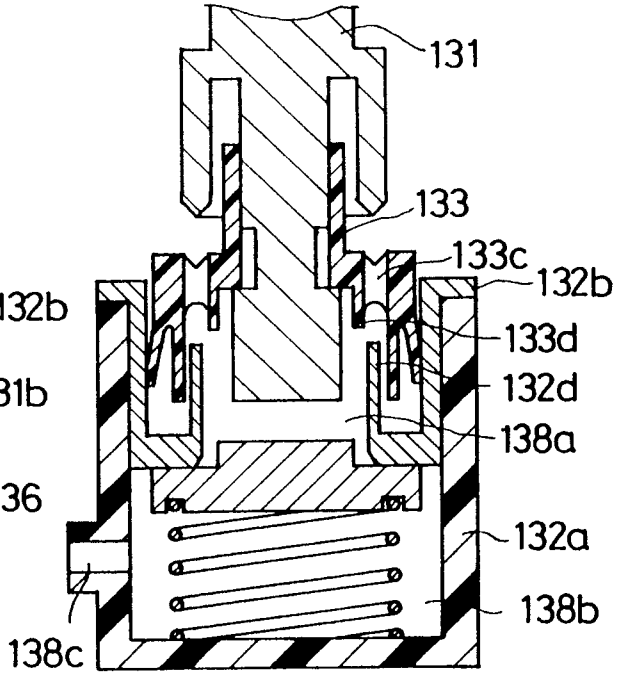

When the rod member 131 is moved together with the piston rod 31 downward from the state where said rod 31 is located at the upper dead center, namely from the state shown in FIG.14A, at first only the rod member 131 is moved downward, while the piston head 133 is not moved. It should be noted that, as the communicating duct 133*c* has been opened, the check valve 136 is kept closed and the liquid soap is not expelled to the inner passageway 138*c*.

When the downward movement with the initial stroke portion S2 is carried out and the valve protrusion 131*c* contacts the V-shaped groove 133*b* as shown in FIG.14B, the valve protrusion 131*c* blocks the communicating duct 133*c* and presses the piston head 133 downward via the valve protrusion 131*c*, so that the piston head 133 is moved downward together with the rod member 131.

Because of the downward movement of the piston head 133, liquid soap inside the upper space 138*a* is under pressure, and the check valve 136 is pushed down by such pressure causing the liquid soap inside the piston head 138*a* to be pushed out into the lower space 138*b*, and the liquid soap inside the lower space 138*b* is expelled from the inner passageway 138*c* through the hose 39*a* and dispensed from the exhaust nozzle 39.

Expulsion from the exhaust nozzle 39 continues until the piston rod 31 reaches lower dead center (the position shown in FIG.14*c*). As a result, the quantity of liquid soap expelled from the exhaust nozzle 39 corresponds to the pump displacement from the position shown in FIG.14B to the position shown in FIG.14C, namely the final stroke portion S3.

Also in this case, the following equation is applicable to the full stroke of the piston rod 31 from the upper dead center to the lower dead center;

$$S1 = S2 + S3.$$

It should be noted that, when the piston rod 31 approaches lower dead center, the lower edge of the pressing section 131*b* contacts the check valve 136 and depresses it.

After the piston rod is once moved downward to the lower dead center (outward movement), when said piston rod 31 is moved upward (inward movement), only the rod member 131 is moved during the movement of the piston rod 31 by the initial initial stroke portion S2. Then, as the check valve 136 is pressed and opened by the pressing section 131*b*, the liquid soap remaining between the inner passageway 138*c* and the exhaust nozzle 39 is sucked back into the lower space 138*b* in response to the upward movement of the rod member 131.

It should be noted that, although the valve protrusion lifts off the V-shaped groove 133*b* and the communicating duct 133*c* is opened, as the clearance between a cylinder wall 132*d* of the cylinder member 132*b* and a cylinder wall 133*d* of the piston head 133 is small, and as the pressing section 131*b* and the check valve 136 move upward generating an upward flow of liquid soap, little liquid soap flows into the upper space 138*a* through the communicating duct 133*c* and the sucking operation, described above occurs.

Figure 14D:
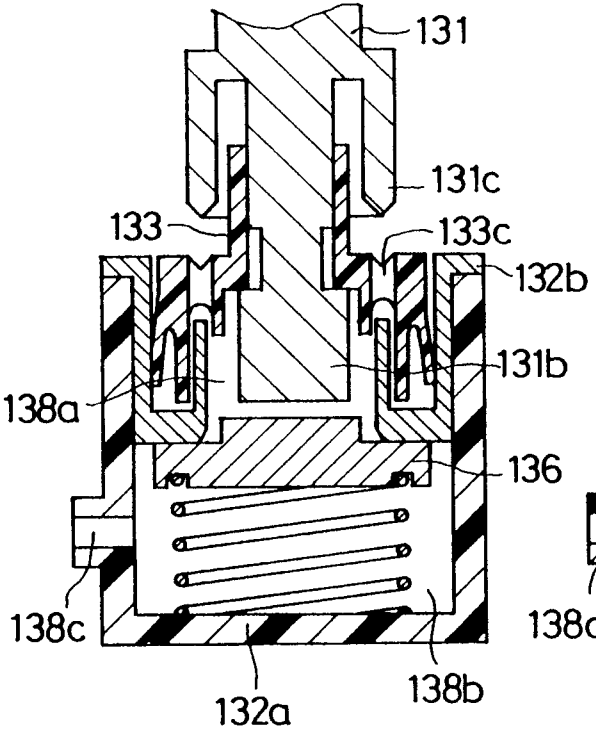

When the rod member 131 has moved upward by only the initial stroke portion and reaches the position shown in FIG.14D, the upper edge of the pressing section 131*b* contacts the bottom surface of the piston head 133, so that from then on the piston head 133 is raised by the pressing section 131*b*. As a result, the piston head 133 is moved upward together with the rod member 131 by only the final stroke portion S3 and reaches the upper dead center.

During the upward movement by the final stroke portion S3, the cylinder wall 132*d* of the cylinder member 132*b* lifts off from the cylinder wall 133*d* of the piston head 133, and the liquid soap inside the tank space 13*c* flows into the upper space 138*a* via the communicating duct 133*c*.

FIGS.15A through 15E illustrate operations of an exhaust mechanism 232 according to the third embodiment of the present invention which is described below.

The exhaust mechanism 230 has a cylinder 232 fixed to the upper casing 13 and a piston head 233 slidably provided in a cylinder bore 232*a* formed in the cylinder 232. A vertical rod receiving passageway 233*a* is formed through the center of the piston head 233, and a lower portion of the piston rod 231 is slidably inserted into the rod receiving passageway 233*a* in the vertical direction. On the lower edge section of the piston rod 231 a pressing section 231*b* is formed to protrude downward from the rod receiving passageway 233*a* and has a larger diameter than that of the rod receiving passageway 233*a*.

The piston rod 231 is received in a passageway 232*d* of the cylinder 232 and guided for vertical sliding movement. An opening 232*c* communicating with the tank space 13*a* is formed in the cylinder 232.

A plurality of communicating ducts 233*b* are arranged in the piston head 233, and a flexible, sheet form, flap valve 235 is attached to the bottom surface of the piston head 233 to blocking these communicating ducts 233*b*. A shouldered portion 231*c* is arranged in the piston rod 231, and because of the construction the piston rod 231 can make a relative movement against the piston head 233 from the position where the upper edge of the pressing section 231*b* contacts the bottom surface of the piston head 233 (the position shown in FIG.15A) to the position where the shouldered portion 231*c* contacts the upper surface of the piston head 233 (the position shown in FIG.15B), and a distance of the relative movement is the initial stroke portion S2.

A partition wall 232*b* having an opening is arranged inside the cylinder 232, and a check valve 236 energized by a spring 236*a* is attached to the partition wall so that the check valve 236 covers the opening, and an inner space of the cylinder 232 is divided by the partition wall 232*b* and the check valve 236 to an upper pressure chamber 238*a* and a lower chamber 238*b*. It should be noted that the lower chamber 238*b* communicates from an inner passageway 238*c* via a hose 39*a* to the exhaust nozzle 39.

An operation in which the piston rod 231 is moved reciprocally in the vertical direction in the exhaust mechanism of the third example will now be described.

Figure 15C:
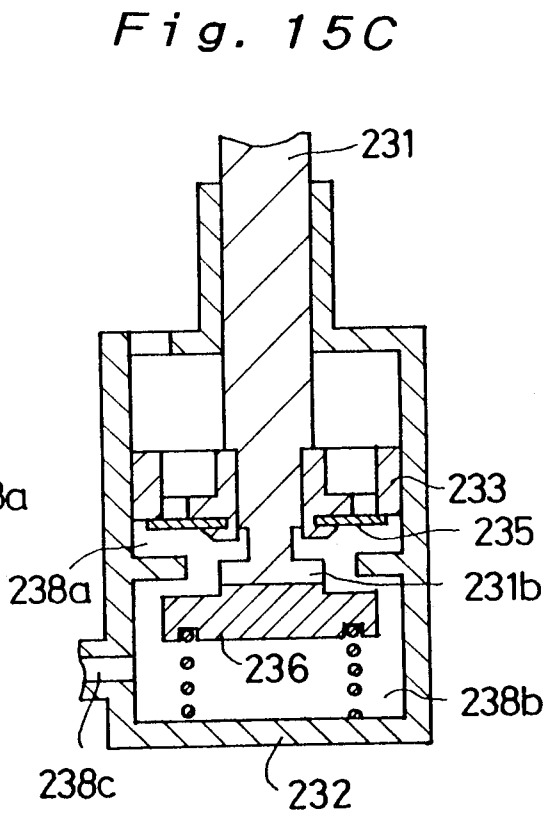
FIGS. 15A through 15E are cross sections of an exhaust mechanism of a dispenser according to a third example of the invention, in successive operating positions.
Figure 15B:
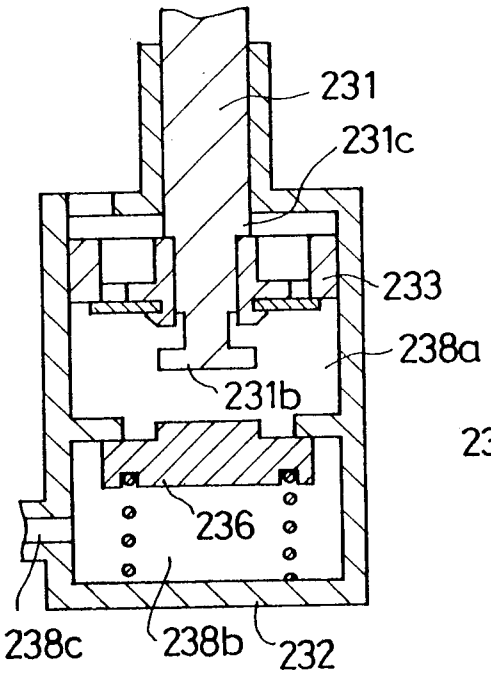
Figure 15A:
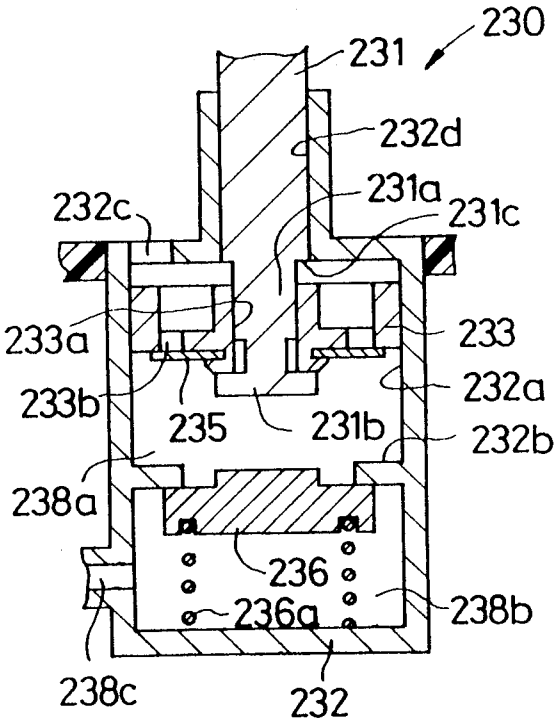

When the piston rod 231 is moved downward from upper dead center, namely from the state as shown in FIG.15A, the piston head 233 is not moved until the initial stroke portion is complete when the shouldered portion 231*c* contacts and pushes the upper surface of the piston head 233, downward with the piston rod 231.

The downward movement of the piston head 233, increases the pressure inside the chamber 238*a* and the check valve 236 is depressed by the pressure causing the liquid soap inside the pressure chamber 238*a* to be expelled into the lower chamber 238*b*, and the liquid soap inside the lower chamber 238*b* to be expelled from the exhaust nozzle 39 through the hose 39*a* from the inner passageway 238*c* to the exterior.

Expulsion from the exhaust nozzle is continued until the piston rod 231 reaches lower dead center (the position shown in FIG.15C). As a result, the quantity of liquid soap expelled and dispensed from the exhaust nozzle 39 corresponds to the displacement of a stroke portion from the position shown in FIG.15*b* to the position shown in FIG.15C. Also in this case, the following equation can be applied to the first stroke S1 from the upper dead center for the piston head 231 to the lower dead center;

$$S1 = S2 + S3$$

When the piston rod approaches lower dead center, the lower edge of the pressing section 231*b* contacts the check valve 236 and depresses it.

After the piston rod 231 has passed through lower dead center (forward movement) and then moves upward (return movement), only the piston rod 231 is moved upward during the initial movement by the initial stroke portion S2. Then, as the check valve 236 is maintained open by the pressing section 231*b*, liquid soap remaining between the inner passageway 238C and the exhaust nozzle 39 is sucked into the lower chamber 238*b* as a result of the upward movement of the piston rod 231.

The upward movement produces suction which would tend to open a flap valve 235, but as the pressing section 231*b* and the check valve 236 also move upward generating an upward movement of the liquid soap, the upward flow offsets the suction force from the upward movement of the piston rod, so that the flap valve 235 seldom opens and the residual soap is sucked back efficiently.

Figure 15E:
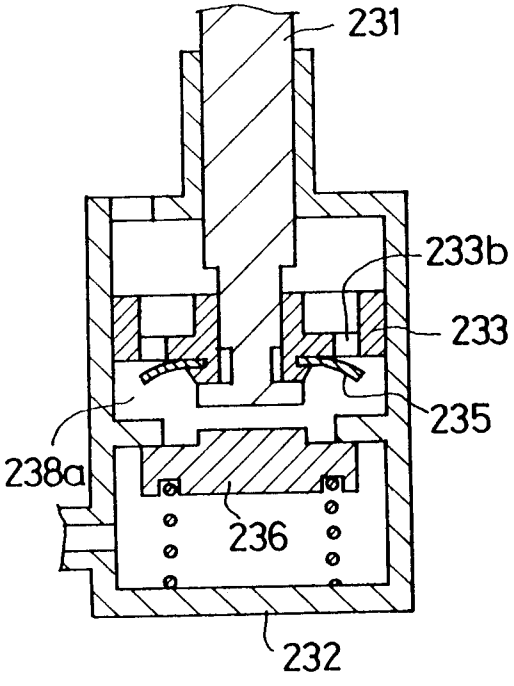
Figure 15D:
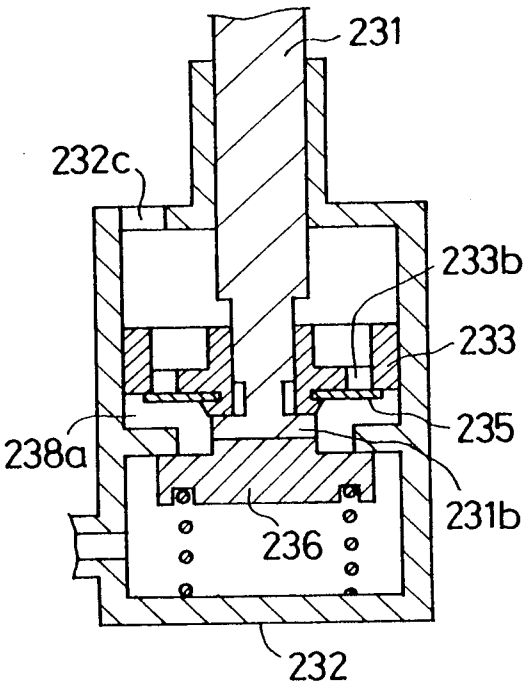

When the piston rod 231 has moved upward by only the initial stroke portion S2 and reaches the position shown in FIG.15D, the upper edge of the pressing section 231*b* contacts the bottom surface of the piston head 233, and from then on the piston head is raised upward by the pressing section 231*b*. For this reason, the piston head 233 is moved upward by the final stroke portion together with the piston rod 231 and reaches the upper dead center.

During the upward movement of the final stroke portion, the flap valve 235 is opened as shown in FIG.15E, and the liquid soap inside the tank space 13*c* flows into the upper chamber 238*a*.

Figure 16:
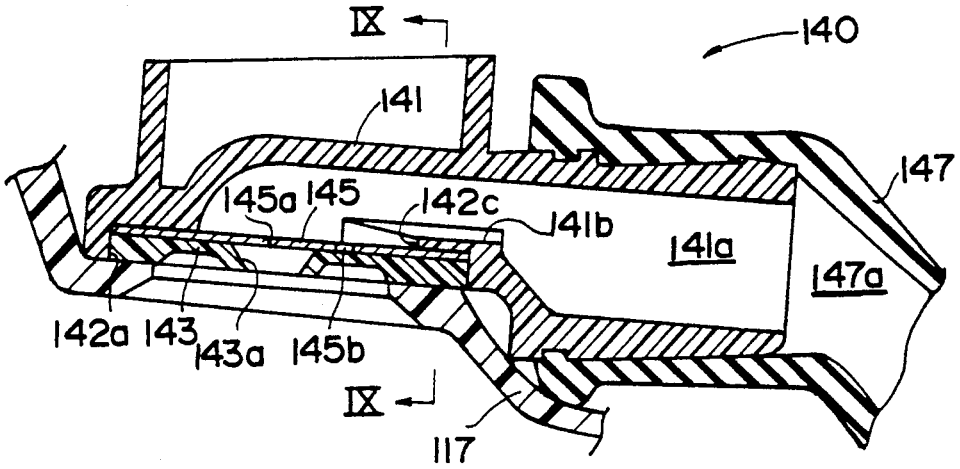
FIG. 16 is an enlarged cross section of an alternative construction of exhaust port of the above-described dispenser.

The exhaust port in the dispenser according to the present invention may be constructed as shown in FIG.16.

Figure 20:
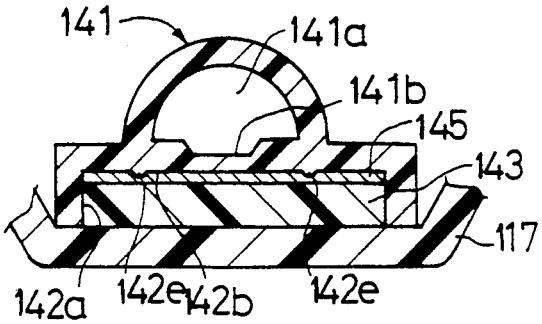
FIG. 20 is a cross section of the exhaust port construction taken along the line IX—IX in FIG. 5, and FIGS. 21A, 21B and 21C, respectively, are cross sections illustrating successive stages of an operation to expel liquid soap from said exhaust port construction.

The exhaust port 140 has an exhaust nozzle 141 and a communicating tube 147, and the exhaust mechanism 30 is connected to the exhaust nozzle 141 via the communicating duct 147. The exhaust nozzle 141 has a first passageway 141*a* which extends from a coupling block for connection with the communicating tube to the tip section, and the first passageway 141*a* extends inclined upward by a few degrees to the horizontal to the tip section. It should be noted that a second passageway 147*a* is arranged inside the communicating tube 147 and the exhaust passageway comprises the first passageway 141*a* and second passageway 147*a*. On the bottom surface of the tip section of the first passageway 141*a* an opening is formed, and an exhaust port spacer 143 is attached to this section with the opening arranged therein to hold an exhaust port plate 145 made of rubber therebetween from the bottom surface side. Furthermore, as shown in FIG.20, a groove 141b is arranged from the section of the first passageway 141a with an opening arranged therein to the bottom surface of the coupling block.

Figure 18A:
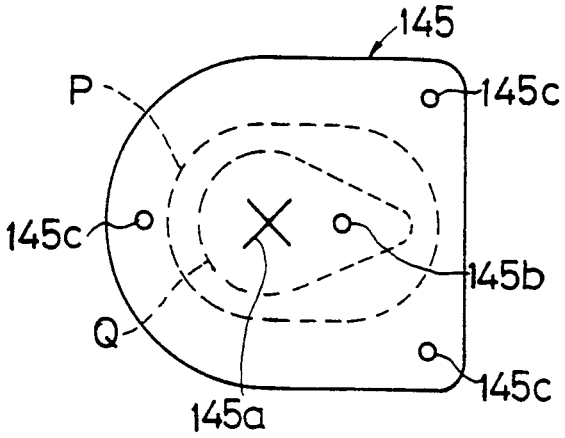
FIGS. 18A and 18B are plan views each illustrating an exhaust port plate constituting the exhaust port construction described above.
Figure 19:
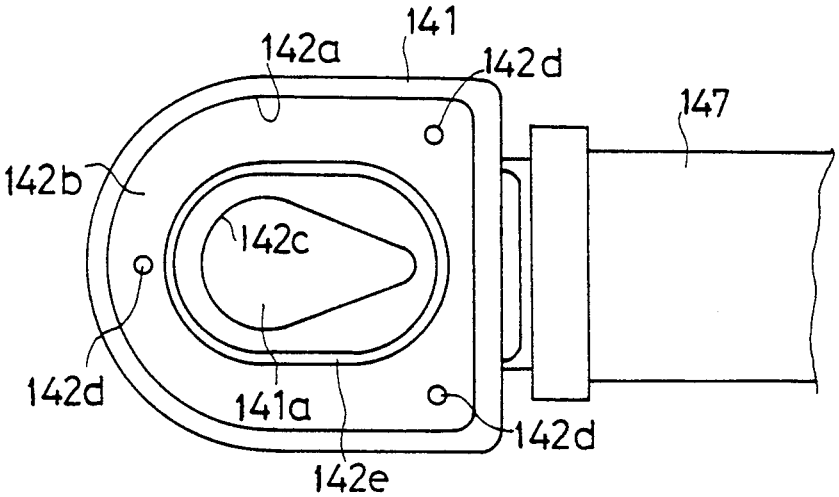
FIG. 19 is a bottom view of an exhaust nozzle of the exhaust port construction described above.

FIG.18A shows the section of the exhaust nozzle 141 with an opening therein viewed from the side of its bottom surface in the condition where the exhaust spacer 143 and the exhaust port plate 145 have been removed and, as shown in FIG.19, a flanged portion 142a is formed on the side of the bottom surface. An opening 142c is formed in the flanged surface surrounded by the flanged portion 142a, and the first passageway 141a is opened downward via the opening 142C. An elliptic convex section 142e surrounding the opening 142c is formed in the flanged surface 142b, and in addition mounting holes 142d are formed at three places in the outer section.

Figure 17A:
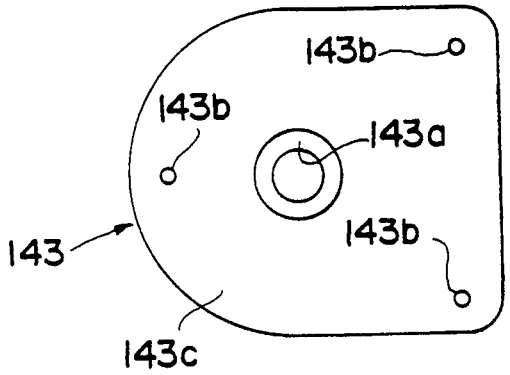
FIGS. 17A, 17B and 17C are, respectively, a plan view, a front view, and a cross section illustrating an exhaust port spacer of the exhaust port construction described above.
Figure 17C:
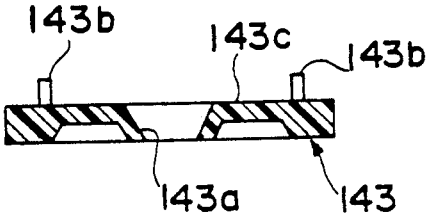
Figure 17B:
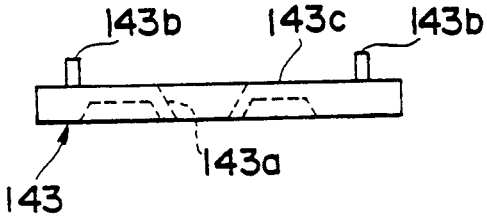

The exhaust spacer 143 and the exhaust port plate 145 have an outer profile corresponding to said flanged portion 142a, the exhaust port plate 145 is formed to contact the flanged surface 142b from the lower side, and the exhaust port spacer 143 is attached on it. As shown in FIGS.17A through 17C, an opening as an exhaust port 143a is formed almost at a center of the exhaust port spacer 143, and on the upper surface 143c thereof (the surface contacting the exhaust port plate 145) three protrusions 143b for mounting are formed at locations corresponding to said mounting hole 142d.

Also as shown in FIG.18A, a cruciform notch 145a is formed at a position corresponding to said exhaust port 143a on the exhaust port plate 145, and at the same time a small hole 145b for suck- back is arranged at the back of and near the notch 145a (in the side of root). Three mounting sockets 145c are formed at positions corresponding to said protrusions 143b.

Figure 18B:
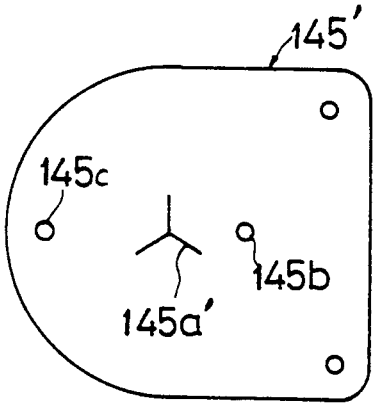

It should be noted that a notch to be arranged on the exhaust plate 145 may be a Y-shaped notch 145a' as shown in FIG.18B.

The exhaust port spacer 143 and the exhaust plate 145 are attached onto the flanged surface 142b by inserting the mounting protrusion 143b into the insertion hole 145c as well as into the mounting hole 142d. In this operation, the exhaust port plate 145 is retained pressed against the flanged surface 142b by the exhaust port spacer 143, but as an elliptic convex section 142e is arranged on the flanged surface 142b, the exhaust port plate 145 is tightly held in this section (in the section indicated by the broken line P in FIG.18A).

When assembled as described above, the section of the upper surface of the exhaust plate 145 surrounded by a broken line Q in FIG.18A faces the first passageway 141a via the opening 142c of the exhaust nozzle 141. As a result, both the notch 145a and the small hole 145b for suck-back face the first passageway 141a via the opening 142c. On the other hand, a small hole for suck-back is blocked by the upper surface of the exhaust port spacer 143.

Figure 21A:
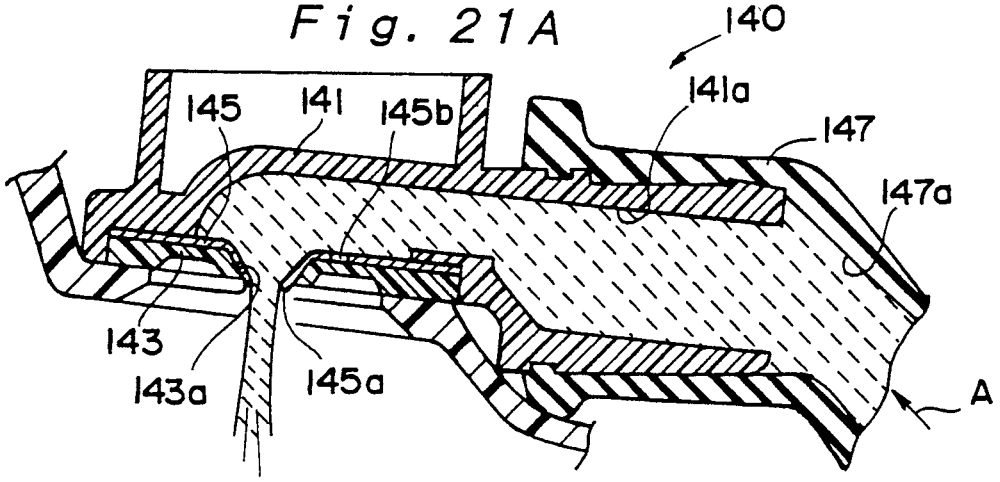
Figure 21B:
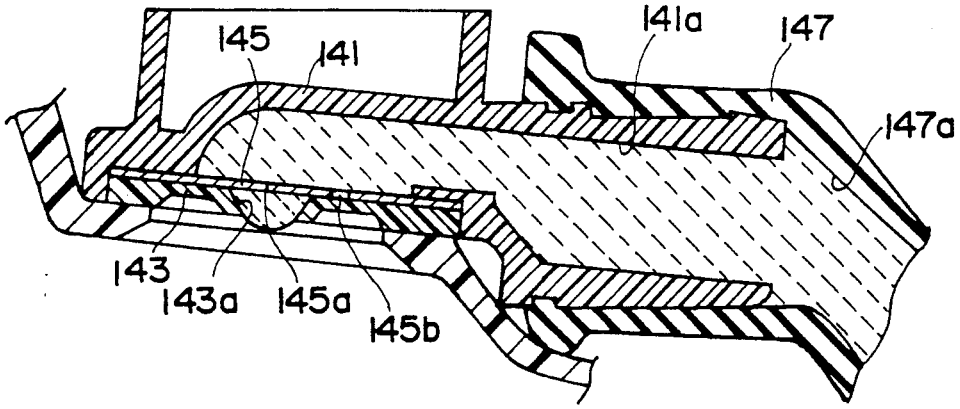

In the construction described above, when the liquid soap inside the pressure chamber 38 is expelled into the inner passageway 32b as a result of the downward movement of the piston head 33 and to the first passageway 141a through a second passageway 147a, the liquid soap is pushed in the direction indicated by the arrow A in FIG.21A, the crossformed notch 145a is expanded open by the internal pressure as shown in the figure, and the liquid soap 1 is expelled from the exhaust port 143a of the exhaust port spacer 143 to the exterior.

As the small hole 145b for suck-back faces the upper surface of the exhaust port spacer 143, the liquid soap 1 is not expelled through the small hole 145b even if the internal soap pressure is high, as described above.

Figure 21C:
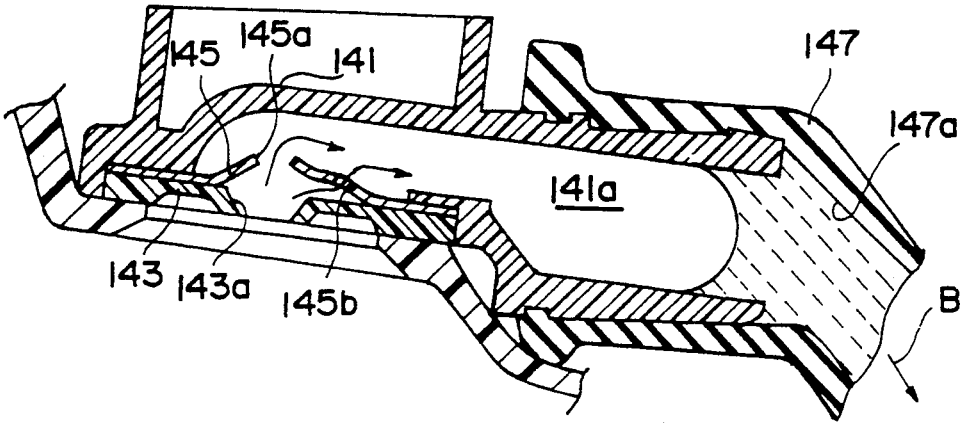

When the piston rod 31 is moved upward and the liquid soap inside the inner passageway 32b is sucked back, the liquid soap 1 remaining in the first passageway 141a and the second passageway 147a is sucked back to the inner passageway 32b. Then, the section with the notch 145a arranged therein of the exhaust port plate 145 is drawn and widened inwardly as shown in FIG.21C because of the sucking pressure (negative pressure), and external air is sucked into the first passageway 141a. As a result, the liquid soap remaining in the first passageway 141a is sucked back to the second passageway 147a as indicated by the arrow B in the figure.

Furthermore, when said sucking pressure is high and the exhaust port is loaded with soap, a portion of the exhaust port plate 145 facing the opening 142c becomes raised as shown in the figure, enabling the liquid soap to be sucked back also through the small hole 145b even from regions under the exhaust port plate 145 so that the liquid soap does not remain in the exhaust port 143a.

The liquid soap sucked into the first passageway 141a as described above is sucked back to the second passageway 147a, and even if a small quantity of liquid soap remains deposited on the inner surface of the first passageway 141a as a result of the upward inclination of the first passageway 141a the residual liquid soap flows down the inclination into the second passageway 147a and little remains inside the first passageway 141a. To enable the residual liquid soap to flow smoothly, the groove 141b is formed on the bottom surface of the first passageway 141a.

The above description assumes a type of device which is hooked on a wall, but other types of device such as those placed, for instance, on a table are possible.

Also, in the above embodiment, a piston rod is moved reciprocally by driving a motor with a dry battery, but the piston rod may be moved reciprocally by such a device as a solenoid, and furthermore electric power may be supplied, not from a dry battery, but from a receptacle for utility to drive such a driving means as a motor or a solenoid.

We claim:

1. A liquid dispenser of the type comprising a tank providing a supply of liquid to be dispensed, a pump comprising a cylinder communicating with the tank and having a cylinder head connected, via a normally closed check valve, to an outlet passageway, a working piston having a piston rod with a piston head mounted for reciprocation in the cylinder thereby defining with the cylinder head a liquid pressure chamber of variable size whereby liquid is drawn into the pressure chamber from the supply during an intake stroke and a prespecified amount of liquid is expelled from the pressure chamber therefrom through the check valve to the outlet passageway during an exhaust stroke, the improvements residing in that ducts are formed in the piston head for permitting flow of liquid from the supply therethrough into the pressure chamber, the piston rod includes a valve member for closing the ducts and check valve engaging means at a leading end thereof, and in that the piston head is mounted on the piston rod for limited lost motion therewith in the direction of reciprocation during initial portions of both the intake and exhaust strokes whereby, for an initial portion of the exhaust stroke, as a result of the lost motion, the piston rod and valve member can move relatively towards the piston head and, subsequently, when such lost motion has been taken up, engage and push the piston head towards the cylinder head with the valve member in sealing engagement with the ducts, closing the pressure chamber to prevent flow of liquid therethrough and causing an increasing pressure of liquid therein to open the check valve and expel a prespecified volume of liquid, determined by the total displacement of the exhaust stroke less the displacement of the lost motion, through the check valve into the outlet passageway, the check valve engaging means being carried into engagement with the check valve towards the end of the exhaust stroke and maintaining the check valve open at a first stage of the intake stroke, during which, return movement of the piston rod causes liquid remaining in the outlet passageway to be sucked back towards the pressure chamber and the valve member to be removed from the ducts and so that, after take up of the lost motion, the piston rod can engage and move the piston head, permitting liquid to be drawn from the supply through the ducts into the pressure chamber.

2. A liquid dispenser according to claim 1, having an object detecting means utilizing an infrared ray, and a rod driving means which is caused to move when it receives a detection signal from said object detecting means, and said rod driving means reciprocates said piston rod once, each time it receives a detection signal from said object detecting means.

3. A liquid dispenser according to claim 2, wherein a stroke adjusting mechanism for adjusting the stroke of said piston rod is provided between said rod driving means and said piston rod whereby the volume of liquid expelled from said outlet passageway can be adjusted.

4. A liquid dispenser according to claim 2, including an electric drive which reciprocates said piston rod, a power source to supply power for driving said electric drive, and switching means which is provided in a line for supply of electric power to said electric drive for on/off control of the power source, and said switching means includes a photo sensor which detects brightness around said liquid dispenser, and said switching means is turned on only when said photo sensor detects that the ambient brightness is higher than a prespecified level so that electric power is supplied to said electric drive from said power source via said line.

5. A liquid dispenser according to claim 1, wherein the outlet passageway terminates at an outlet end in an exhaust port and a rubber cap is mounted so as to cover said exhaust port, said rubber cap having a notch in a section facing said exhaust port, said exhaust port being normally kept sealed by the rubber cap, and said section with said notch formed therein being pushed outwardly and opened by a pressure generated in the liquid by said piston when said liquid is expelled.

6. A liquid dispenser according to claim 5, wherein the liquid in said cylinder is expelled from said exhaust port through said outwardly opened section in accordance with forward movement of said piston, air is sucked into said exhaust port by drawing inwardly and opening said section with said notch formed therein by the initial stroke portion of the return movement of said piston rod, and at the same time the liquid in said passageway connecting said cylinder head to said exhaust port is sucked back into said cylinder head.

7. A liquid dispenser according to claim 1, wherein the outlet passageway terminates at an outlet end in a downwardly facing exhaust port and a thin flexible plate is mounted to said exhaust port covering an upper side thereof and a notch is formed in said flexible plate facing said exhaust port so that, normally, said exhaust port is covered by said flexible plate and said notch formed therein is pushed outwardly and opened by a pressure generated in the liquid by said piston when said liquid is expelled, and at least a section of said passageway adjacent said exhaust port is arranged to extend inclined upwards as it extends toward the exhaust port.

8. A liquid dispenser according to claim 7, wherein a small hole through which liquid can be sucked back is formed in a vicinity of said notch of said flexible plate, and the liquid in said cylinder is expelled from said exhaust port by pushing and opening outwardly said notch in accordance with forward movement of said piston, the liquid in said outlet passageway is sucked back into said cylinder by an initial stroke portion of the return movement of said piston rod during the intake stroke, and liquid which is left in said exhaust port is sucked back into said outlet passageway through said notch and said small hole.

9. A liquid dispenser according to claim 1, including an electric drive which reciprocates said piston rod, a power source to supply power for driving said electric drive, and switching means which is provided in a line for supply of electric power to said electric drive for on/off control of the power source, and said switching means includes a photo sensor which detects brightness around said liquid dispenser, and said switching means is turned on only when said photo sensor detects that the ambient brightness is higher than a prespecified level so that electric power is supplied to said electric drive from said power source via said line.

10. A liquid dispenser according to claim 9, including a control unit has an object detecting sensor to detect whether an object has been positioned under said outlet passageway, and said electric drive is operated when the object detecting sensor detects an object positioned under said outlet passageway and said object detecting sensor is operated by electric power supplied from said power source through said switching means.

11. A liquid dispenser according to claim 10, wherein said object detecting sensor comprises an infrared ray emitting means and an infrared ray receiving means to detect infrared rays reflected from an object, and wherein infrared rays are emitted by said infrared ray emitting means at prespecified intervals.

12. A liquid dispenser of the type comprising a tank providing a supply of liquid to be dispensed, a pump comprising a cylinder communicating with the tank and having a cylinder head connected via a normally closed check valve, to an outlet passageway, a working piston having a piston rod with a piston head mounted for reciprocation in the cylinder thereby defining with the cylinder head a liquid pressure chamber of variable size whereby liquid is drawn into the pressure chamber from the supply during an intake stroke and a prespecified amount of liquid is expelled from the pressure chamber therefrom through the check valve into the outlet passageway during an exhaust stroke, the improvements residing in that the piston rod has check valve engaging means at a leading end thereof and in that the piston head has ducts therein for permitting flow of liquid from the supply therethrough into the pressure chamber and pressure sensitive valve means for closing the ducts and is mounted on the piston rod for limited lost motion therewith in the direction of reciprocation during initial portions of both the intake and exhaust strokes whereby, for an initial portion of the exhaust stroke, the piston rod can move relatively towards the piston head and, subsequently, when the lost motion has been taken up, engage and push the piston head towards the cylinder head, such movement increasing the liquid pressure, operating the valve means to close the ducts thereby closing the pressure chamber causing an increasing pressure of liquid therein to open the check valve and expel a prespecified volume of liquid, determined by the total displacement of the exhaust stroke less the displacement of lost motion, through the check valve into the outlet passageway, the check valve engaging means being carried into engagement with the check valve towards the end of the exhaust stroke and maintaining the check valve open at a first stage of the intake stroke, during which, return movement of the piston rod causes liquid remaining in the outlet passageway to be sucked back towards the pressure chamber, and so that, after take up of the lost motion, the piston rod can engage and move the piston head, liquid pressure from such movement opening the valve means permitting liquid to be drawn from the supply through the ducts into the pressure chamber.

13. A liquid dispenser according to claim 12, having an object detecting means utilizing an infrared ray, and a rod driving means which is caused to move when it receives a detection signal from said object detecting means, and said rod driving means reciprocates said piston rod once, each time it receives a detection signal from said object detecting means.

14. A liquid dispenser according to claim 13, wherein a stroke adjusting mechanism for adjusting the stroke of said piston rod, is provided between said rod driving means and said piston rod whereby the volume of liquid expelled from said outlet passageway can be adjusted.

15. A liquid dispenser according to claim 13, including an electric drive which reciprocates said piston rod, a power source to supply power for driving said electric drive, and switching means which is provided in a line for supply of electric power to said electric drive for on/off control of the power source, and said switching means includes a photo sensor which detects brightness around said liquid dispenser, and said switching means is turned on only when said photo sensor detects that the ambient brightness is higher than a prespecified level so that electric power is supplied to said electric drive from said power source via said line.

16. A liquid dispenser according to claim 12, wherein the outlet passageway terminates at an outlet end in an exhaust port and a rubber cap is mounted so as to cover said exhaust port, said rubber cap having a notch in a section facing said exhaust port, said exhaust port being normally kept sealed by the rubber cap, and said section with said notch formed therein being pushed outwardly and opened by a pressure generated in the liquid by said piston when said liquid is expelled.

17. A liquid dispenser according to claim 16, wherein the liquid in said cylinder is expelled from said exhaust port through said outwardly opened section in accordance with forward movement of said piston, air is sucked into said exhaust port by drawing inwardly and opening said section with said notch formed therein by the initial stroke portion of the return movement of said piston rod, and at the same time the liquid in said passageway connecting said cylinder head to said exhaust port is sucked back into said cylinder head.

18. A liquid dispenser according to claim 12, wherein the outlet passageway terminates at an outlet end in a downwardly facing exhaust port and a thin, flexible plate is mounted to said exhaust port covering an upper side thereof and a notch is formed in said flexible plate facing said exhaust port so that normally, said exhaust port is covered by said flexible plate and said notch formed therein is pushed outwardly and opened by a pressure generated in the liquid by said piston when said liquid is expelled, and at least a section of said passageway adjacent said exhaust port is arranged to extend inclined upwards as it extends toward the exhaust port.

19. A liquid dispenser according to claim 18, wherein a small hole through which liquid can be sucked back is formed in a vicinity of said notch of said flexible plate, and the liquid in said cylinder is expelled from said exhaust port by pushing and opening outwardly said notch in accordance with forward movement of said piston, the liquid in said outlet passageway is sucked back into said cylinder by an initial stroke portion of the return movement of said piston during the intake stroke, and liquid which is left in said exhaust port is sucked back into said outlet passageway through said notch and said small hole.

20. A liquid dispenser according to claim 12, including an electric drive which reciprocates said piston rod, a power source to supply power for driving said electric drive, and switching means which is provided in a line for supply of electric power to said electric drive for on/off control of the power source, and said switching means includes a photo sensor which detects brightness around said liquid dispenser, and said switching means is turned on only when said photo sensor detects that the ambient brightness is higher than a prespecified level so that electric power is supplied to said electric drive from said power source via said line.

21. A liquid dispenser according to claim 20, including a control unit having an object detecting sensor to detect whether an object has been positioned under said outlet passageway, and said electric drive is operated when the object detecting sensor detects an object positioned under said outlet passageway, and said object detecting sensor is operated by electric power supplied from said power source through said switching means.

22. A liquid dispenser according to claim 21, wherein said object detecting sensor comprises an infrared ray emitting means and an infrared ray receiving means to detect infrared rays reflected from an object, and wherein infrared rays are emitted by said infrared ray emitting means at prespecified intervals.

* * * * *